US006698369B2

(12) United States Patent
Kwak

(10) Patent No.: US 6,698,369 B2
(45) Date of Patent: Mar. 2, 2004

(54) EMBROIDERY MACHINE

(75) Inventor: Su Moon Kwak, Inchon (KR)

(73) Assignee: Sunstar Precision Co., Ltd., Inchon (KR)

( * ) Notice: Subject to any disclaimer, the term of this patent is extended or adjusted under 35 U.S.C. 154(b) by 146 days.

(21) Appl. No.: 09/854,888

(22) Filed: May 14, 2001

(65) Prior Publication Data

US 2001/0054371 A1 Dec. 27, 2001

(30) Foreign Application Priority Data

May 25, 2000 (KR) ..... 2000-28445
Jul. 5, 2000 (KR) ..... 2000-38160
Jul. 31, 2000 (KR) ..... 2000-44193

(51) Int. Cl.[7] ..... D05C 5/02; D05B 21/00; D05B 25/00

(52) U.S. Cl. ..... 112/102.5; 112/155; 112/470.18

(58) Field of Search ..... 112/470.18, 470.06, 112/470.14, 155, 103, 102.5

(56) References Cited

U.S. PATENT DOCUMENTS 4,051,793 A 10/1977 Reich
5,167,194 A 12/1992 Nakagaki
5,408,944 A * 4/1995 Hayashi ..... 112/103
5,474,001 A 12/1995 Tajima et al.
6,330,864 B1 * 12/2001 Tajima ..... 112/470.18

* cited by examiner

*Primary Examiner*—Peter Nerbun
(74) *Attorney, Agent, or Firm*—Akin Gump Strauss Hauer & Feld, L.L.P.

(57) ABSTRACT

An embroidery machine includes a plurality of heads installed above a working table and spaced apart from each other. A needle holder inside each head is slidingly movable up and down and includes a plurality of hooks at a lower part vertically opposite to the needle holder. A plurality of embroidery frames are installed between the needle holder and the hook. A guide rail is disposed in the X direction with respect to each embroidery frame, and an X-axis driver linear motor moves the embroidery frame in the X direction. A guide rail is disposed in the Y direction with respect to each embroidery frame, and a Y-axis driver linear motor moves the embroidery frame in the Y direction. A controller controls a plurality of X-axis and Y-axis driver linear motors and actuates or stops only one of the plurality of embroidery frames.

29 Claims, 22 Drawing Sheets

PRIOR ART

PRIOR ART

PRIOR ART

PRIOR ART

PRIOR ART

EMBROIDERY MACHINE

BACKGROUND OF THE INVENTION

1. Technical field

The present invention relates to an embroidery machine, more particularly to X-axis and Y-axis driver units for driving an embroidery frame and interlocking units of the embroidery machine.

2. Description of the Prior Art

In general, an embroidery machine is a two-axis positioning control device in which an embroidery frame into which a raw cloth is fixed moves horizontally in X or Y direction, while a needle holder of a sewing machine moves up and down.

In such an embroidery machine, the precision in movement and constant speed of the embroidery frame is closely involved with the quality of the embroidery because an embroidery frame fixed with raw cloth is configured to embroider the cloth while moving in X and Y directions.

Accordingly, a servo motor, or an induction motor which can control speed is used as a power source for driving the needle holder of the embroidery machine up and down, a stepping motor which has an excellent positioning function and is easy to control is used as a power source for driving the embroidery machine in X and Y directions.

The prior art is described below with reference to the FIG. 22 to FIG. 24. First, there is provided a rectangular table 102, an embroidery frame 104 installed above the table 102 for fixing a cloth on which various patterns are embroidered, a head 106 including a plurality of needles for embroidering the cloth and installed above the embroidery frame 104, and a hook 108 installed below the table 102 opposite to the head 106 for feeding a lower thread.

In this case, an upper shaft 403 and a lower shaft 142 for transmitting power are coupled to the head 106 and the hook 108 respectively. The upper shaft 403 and lower shaft 142 are coupled to a main-shaft driver unit 401 which provides power to the shafts.

An X-axis driver unit 110 is provided on one end portion of the embroidery machine 104. The X-axis driver unit 110 is described below. A connector frame A 112 is coupled with one side of the embroidery frame 104 with slippingly placed on the table 102, and a slider 114 which is located below the table 102 and move back and forth is coupled with the lower part of the connector frame A 112. A front face of the timing belt for transmitting power is coupled with lower end portion of the slider 114, driver timing pulley 116 and follower timing pulley 118 are coupled with one end portion and other end portion of the timing belt respectively, and a shaft 120 for transmitting power is coupled with the driver timing pulley 116.

An X-axis driver motor 122 for providing power is coupled with one end portion of the shaft 120, a control unit, not shown, for transmitting commands is coupled with the X-axis driver motor 122. In addition, a guide rail 115 which serves as a guide is coupled with a lower part of the slider 114, and the driver timing pulley 116 and follower timing pulley 118 are installed rotatably at respective leading end portion and trailing end portion of the guide rail 115.

At the rear part of the embroidery frame 104 there is provided a Y-axis driver unit 120. In the Y-axis driver unit 120, a connector frame B 126 is placed on and coupled slippingly in X direction with the table 102, in the rear end portion of the embroidery frame 104, and a slider 128 moving back and forth is coupled with a lower part of the connector frame B 126.

Also, a front face of the timing belt is coupled with a lower end portion of the slider 128, and a driver timing pulley 130 and a follower gear 132 are coupled with respective leading end portion and trailing end portion of the timing belt.

A shaft 134 is coupled with the driver timing pulley 130, an Y-axis driver motor 136 for providing power is coupled with the shaft 134, then a control unit for transmitting commands is coupled with Y-axis driver motor 136.

In addition, a guide rail 138 which serves as a guide is slippingly coupled with a lower part of the slider 128, and the driver timing pulley 130 and the follower gear 132 are installed rotatably at respective leading end portion and trailing end portion of the guide rail 138.

In the meanwhile, a thread-cut drive unit 140 for cutting unnecessary threads from the head 106 and the hook 108 is located below the table 102, and the structure of the thread-cut drive unit 140 is as follows.

First, in the thread-cut drive unit 140, a driver sprocket 144 is mounted on the lower shaft 142 while winding one side of a chain 146, and a follower sprocket 148 is coupled with a shaft B 152 installed inside a case 150 in other side of the chain 146.

In addition, a cam 154 is coupled with the shaft B 152, a roller 156 is coupled slidingly with the cam 154, and a front end portion of a lever 158 is coupled with the roller 156.

Also, a hinge shaft 160 defining an axis of rotation is coupled with the center of the lever 158, and a solenoid, not shown, for applying force to attach the roller 156 to the cam 154 or to detach the roller 156 from the cam 154 is installed at the lower end portion of the hinge shaft 160.

Further, a pusher 162 for transmitting the force is vertically coupled with the rear end portion of the lever 158, a rod 164 moving back and forth is coupled with the lower end portion of the pusher 162, in this case, the rod 164 extends outwardly through the case 150.

A thread-cut shaft 166 rotating positive or reverse direction by the power transmitted at the time of moving back and forth is installed on the rod 164, a cutter A 168 rotating with the shaft 166 is coupled with the upper end portion of the thread-cut shaft 166 above the hook 108, and a cutter B 170 is located crosswise at the front end portion of the cutter A 168. At this time, the cutter B 170 is fixed to a hook base 172.

In addition, a front end portion of a shaft C 174 which transmits power is coupled to the hook 108, a follower gear 176 formed with helical gear is engaged with the rear end portion of the shaft C 174, a driver gear 178 formed with helical gear is installed at the lower shaft 142 in gear engagement with the follower gear 176.

In the meanwhile, a color-change drive unit 180 for adjusting the head to embroider in various colors is located at one end portion of the head 106 as shown in FIG. 25, the color-change drive unit 180 comprises a rod 182 moving back and forth and coupled with the one end portion of the head 106 at the same time, a block 184 moving back and forth with the rod 182 is coupled with a rear end portion of the rod 182 inside a housing 186.

Also, guide rods 188 that serve as a guide for moving back and forth are coupled slippingly with upper and lower parts of the block 184, and front and rear end portions of the guide rod 188 are coupled with the housing 186 walls respectively.

A sensor pointer 190 configured to check the range of movement of the head 106 is installed at the front part of the block 184, a roller 192 is rotatably coupled with the block 184 rear part.

While, the roller 192 is mounted in a threaded groove of a cam shaft 194 which transmits force for moving the block 184 back and forth, the cam shaft 194 is installed transversely inside the housing 186, the front and rear end portions of the cam shaft 194 are coupled rotatably with walls of the housing 186 respectively, a follower gear 196 for receiving power is coupled with a rear part of the cam shaft 194.

In addition, a driver gear 198 is coupled with a follower gear 196 in gear engagement, the driver gear 198 is coupled with a shaft 202 of a step motor 200 which provides power, and a control unit for transmitting commands is coupled with the step motor 200. In addition, a panel which is not shown is coupled with a front face of the housing 186, a plurality of sensors which are used to determine whether the color of a lower thread has changed or not by sensing the position of the sensor pointer 190 are installed on the panel, the control unit is connected to the sensors.

Next, the structure of the head is described below with reference to the FIG. 26.

First, the head 106 is coupled slippingly with an upper front face of an arm 409 through which an upper shaft 403 connected with a main-shaft driver unit 401 passes. At this time, a driver cam 413 formed with a cam groove 411 in front face thereof is mounted on the arm 409, a cam roller 415 installed on a rotating driver lever 417 is placed in the cam groove 411.

Next, a driver gear 419 is coupled with a front end portion of the driver lever 417, a thread-snatch unit 421 for drawing a single thread located above the driver gear 419 is coupled to the driver gear 419 with its rear part in gear engagement and is installed at the head 106

Further, a rear end portion of a rotating driver lever 423 is mounted on a rear face of the driver cam 413, a slider 425 is coupled with the front end portion of the driver lever 423, and a control block 427 which actuates repeatedly upward and downward is coupled with the slider 425. A needle holder shaft 429 which serves as a guide is coupled slippingly with the control block 427 and mounted vertically at the arm 409.

In addition, a fixed bracket 431 is detachably coupled with the front end portion of the control block 427 and installed at the head 106, and a needle holder 433 which is configured to move a single thread from the thread-snatch unit 421 onto the cloth and to embroider the cloth is coupled with the fixed bracket 431 and installed vertically movably at the head 106.

The operation of the prior art having such composition is described as follows.

First, operation items are inputted in the operating panel in order to embroider various patterns on a cloth, then the control unit transmits commands to the X-axis and Y-axis driver motors 122, 136 and the main-shaft driver unit.

When the X-axis driver motor 122 operates according to a command from the control unit, the driver timing pulley 116 is rotated by the positive or reverse rotation of the shaft 120, accordingly the slider 114 is moved by the timing belt which is engaged partly with the driver timing pulley 116.

The connector frame A 112 pushes or pulls the embroidery frame when the slider 114 moves back and forth as described above, at the same time, the rear part of the embroidery frame 104 moves slidingly in the connector frame B 126 which remains in a fixed position.

When the embroidery frame 104 moves like that, the driver cam 413 is rotated by a part of power transmitted through the upper shaft 403 and provided from the main-shaft driver unit 401, consequently, cam roller 415 located in the cam groove 411 of the driver cam is rotated and is moved by a width in left and right.

Therefore, the driver lever 417 is rotated to move the thread-snatch unit up and down which is coupled with the driver gear 419 in gear engagement, thereby the thread-snatch unit 421 draws a single thread above the embroidery frame 104 and feeds the single thread.

At the same time, the driver cam 413 rotates other driver lever 423, and slides the slider 425 and control block 427 up and down repeatedly on the needle holder shaft 429.

Consequently, the control block 427 causes the fixed bracket 431 and needle holder shaft 429 to move up and down together, and the single thread from the thread-snatch unit 421 to move onto the cloth and to embroider the cloth.

Further, in case the position is needed to be changed when embroidering the cloth, the Y-axis driver motor 136 is operated by a command from the control unit, then the driver timing pulley 130 is rotated in a positive or reverse direction by the rotation of the shaft 134, as a result, the timing belt which winds the driver timing pulley 130 in part moves the slider 128.

Therefore, the slider 128 pushes and pulls the connector frame B 126, and causes the embroidery frame 104 to move forward or backward, at the same time the one end portion of the embroidery frame 104 slides on the connector frame A 112 located in a fixed position When the embroidery frame 104 moves in such a way, needles provided identically in the head as described above move up and down, to embroider on the cloth.

At the same time, a part of the power from the main-shaft driver unit 401 is transmitted through the lower shaft 142 and rotates the driver sprocket 144, thereby the power is transmitted through the chain 146 and rotates the follower sprocket 148.

Further, when the follower sprocket 148 rotates and causes the shaft B 152 and the cam 154 to rotate together, the roller 156 and the shaft B 152 are in idle state because the control unit does not transmit the operating commands to the solenoid yet and accordingly the roller 156 is not engaged with the cam 154. Therefore, the rod 164 remains at an original position and the cutter A 168 is in stationary state.

At the same time, the driver gear 178 is rotated by the rotation of the lower shaft 142 and causes the follower gear 176 which is in gear engagement with the driver gear 178 together with the shaft C 174 to rotate, so that the hook 108 coupled with the front end portion of the shaft C 174 can be rotated.

In the meanwhile, in case a single thread of other colors might be provided while embroidering the cloth, the lower thread provided previously should be cut. At this time, when an operating command is transmitted from the control unit to the solenoid, the hinge shaft 160 is raised with the lever 158 and causes the roller 156 to couple with the cam 154.

As a result of this, the roller 156 is coupled with the cam which has been in idle state, and thereby the cam 154 moves within a predetermined range and causes the lever 158 to move toward a center of the hinge shaft 160.

Therefore, when the pusher 162 installed at the rear end portion of the lever 158 moves leftward and rightward and causes the rod 164 to move forward and backward, then the thread-cut shaft 166 is rotated by the rod 164 and causes the cutter A 168 to rotate. At this time, the cutter A 168 pushes an upper thread near the needle outwardly, and draws upper and lower threads near the cloth toward the cutter B 170 and cuts the threads when returning to the previous position.

When the cutting operation is over as described above, the control unit transmits a command to the step motor 200 in the color-change driver unit 180.

When the step motor 200 is rotated in a positive or reverse direction by a command received as above and causes the follower gear 196 to rotate through the driver gear 198, then the follower gear 196 rotates the cam shift 194 and pushes or pulls the roller 192 so as to move the block 184 forward or backward on the guide rod 188.

Accordingly, the rod 182 moves forward and backward by the block and causes the head 106 to move to a position into which an upper thread of corresponding color is fed.

At this time, the center pointer 180 mounted on the front face of the block 184 is checked by any one of the plurality of sensors mounted on the panel, the information with respect to result is transmitted to the control unit and stops the operation of the step motor 200, thereby the head 106 reaches and stops at the position where the color of the upper thread is changed.

Further, while the control unit transmits the operating command to the X-axis and Y-axis driver motors so as to move the embroidery frame 104 forward and backward as described above, and at the same time causes the needle provided in the head 106 to move up and down so as to embroider the cloth.

The above-described prior art generates great vibration and noise due to its intricate construction in the interlocking units which constitutes X-axis and Y-axis driver units, and a problem in expensive production cost due to the complicated mechanical structure.

There is another problem of the low quality of the embroidery because the power transmission is performed through several steps and thereby it is not possible to control the embroidery frame precisely.

SUMMARY OF THE INVENTION

The present invention is designed to overcome the above problems of the prior art. Therefore, it is a first object of the invention to reduce the vibration and noise in the embroidery machine by simplifying the construction of the interlocking units which constitutes X-axis and Y-axis driver units, and to improve the productivity by reducing the production cost.

It is a second object of the invention to provide a more space-efficient embroidery machine by simplifying the construction of the interlocking units which constitutes X-axis and Y-axis driver units, and reducing the space required for the X-axis and Y-axis driver units.

It is a third object of the invention to simplify a power transmission procedure by installing a vertical driver unit inside each head so as to drive needles separately according to each head.

It is a fourth object of the invention to simplify a power transmission procedure and reduce operating errors of a needle holder and a hook by installing a vertical driver unit inside each head and, in addition, constructing the hook interlocked with the vertical driver unit to be driven separately from the unit.

It is a fifth object of the invention to simplify interlocking units and to reduce vibration and noise by constructing not only a needle holder and a hook but also an embroidery frame to be driven separately.

It is a sixth object of the invention to simplify interlocking units, to reduce significantly the vibration and noise of the entire embroidery machine and to perform various embroidery operations with one embroidery machine so as to maximize the effectiveness of operation and at the same time to make mass production of the embroideries possible, by disposing an embroidery frame in each head group, simplifying the construction of X-axis and Y-axis driver unit which drives the embroidery frame of each head group, and separately driving a vertical driver unit for moving a needle holder of the head, a hook, and the embroidery frame respectively.

The first object of the invention is accomplished by an embroidery machine comprising: a table; an embroidery frame placed on the table; a head located above the embroidery frame, the head having a plurality of needles; a hook installed below the table, the hook being opposite to the head; an X-axis driver unit for providing power to move the embroidery frame forward and backward in X direction; an Y-axis driver unit for providing power to move the embroidery frame forward and backward in Y direction; and a control unit for being connected to the X-axis driver unit and Y-axis driver unit.

The second object of the invention is accomplished by an embroidery machine comprising: a table; an embroidery frame slippingly placed on the table; a head located above the embroidery frame, the head having a plurality of needles; and a hook installed below the table, the hook being opposite to the head, wherein an XY system for providing power to move the embroidery frame in X and Y directions is mounted on a central portion of a rear side of the embroidery frame, a control unit is coupled to the XY system.

In addition, the second object of the invention is accomplished by an embroidery machine comprising: a table; an embroidery frame slippingly placed on the table; a head located above the embroidery frame, the head having a plurality of needles; and a hook installed below the table, the hook being opposite to the head, wherein an XY table for providing power to move the embroidery frame in X and Y directions is mounted on a central portion of a rear side of the embroidery frame, a control unit is coupled to the XY table.

The third object of the invention is accomplished by an embroidery machine comprising: a plurality of heads installed above a working table; a needle holder installed inside each head and slidingly movable up and down; a vertical driver unit for moving the needle holder up and down, the vertical driver unit being installed inside each head; and a controller for controlling a plurality of the vertical driver units.

The fourth object of the invention is accomplished by an embroidery machine comprising: a plurality of heads installed above a working table; a needle holder mounted inside each head and slidingly movable up and down; a vertical driver means mounted on one side of each head and causing the needle holder to move up and down; a plurality of hooks installed at a lower part of the needle holder and vertically opposite to the needle holder; a small-sized motor mounted at a rotatory shaft of each hook; and a controller for controlling a plurality of vertical driver means and a plurality of small-sized motors.

The fifth object of the invention is accomplished by an embroidery machine comprising: a plurality of heads installed above a working table and spaced apart each other; a needle holder installed inside each head and slidingly movable up and down; a plurality of hooks installed at a lower part of each needle holder and vertically opposite to the needle holder; a plurality of embroidery frames installed between the needle holder and the hook, and movable in X or Y direction; a guide rail disposed in X direction of each embroidery frame; an X-axis driver linear motor for moving the embroidery frame in X direction while moving along the guide rail; a guide rail disposed in Y direction of each embroidery frame; an Y-axis driver linear motor for moving the embroidery frame in Y direction while moving along the guide rail; and a controller for controlling a plurality of X-axis and Y-axis driver linear motors.

The sixth object of the invention is accomplished by an embroidery machine comprising: a plurality of heads installed in groups above a working table and spaced apart each other; a needle holder installed inside each head and slidingly movable up and down; a vertical driver means mounted on one side of each head and causing the needle holder to move up and down; a plurality of hooks installed at a lower part of each needle holder and vertically opposite to the needle holder; a small-sized motor mounted on a rotatory shaft of each hook; a plurality of embroidery frames installed on an upper surface of the working table according to each head group, and movable in X or Y direction; a guide rail disposed in X direction of each embroidery frame; an X-axis driver linear motor for moving the embroidery frame in X direction while moving along the guide rail; a guide rail disposed in Y direction of each embroidery frame; an Y-axis driver linear motor for moving the embroidery frame in Y direction while moving along the guide rail; and a controller for controlling the plurality of vertical driver means, the plurality of small-sized motors, and the plurality of X-axis and Y-axis driver linear motors.

BRIEF DESCRIPTION OF THE DRAWINGS

These and other features, aspects, and advantages of the present invention will become better understood with regard to the following description, append portioned claims, and accompanying drawings, in which like components are referred to by like reference numerals. In the drawings:

DETAILED DESCRIPTION OF THE PREFERRED EMBODIMENT

Hereinafter, preferred embodiments of the present invention will be described in detail with reference to the accompanying drawings.

Figure 1:
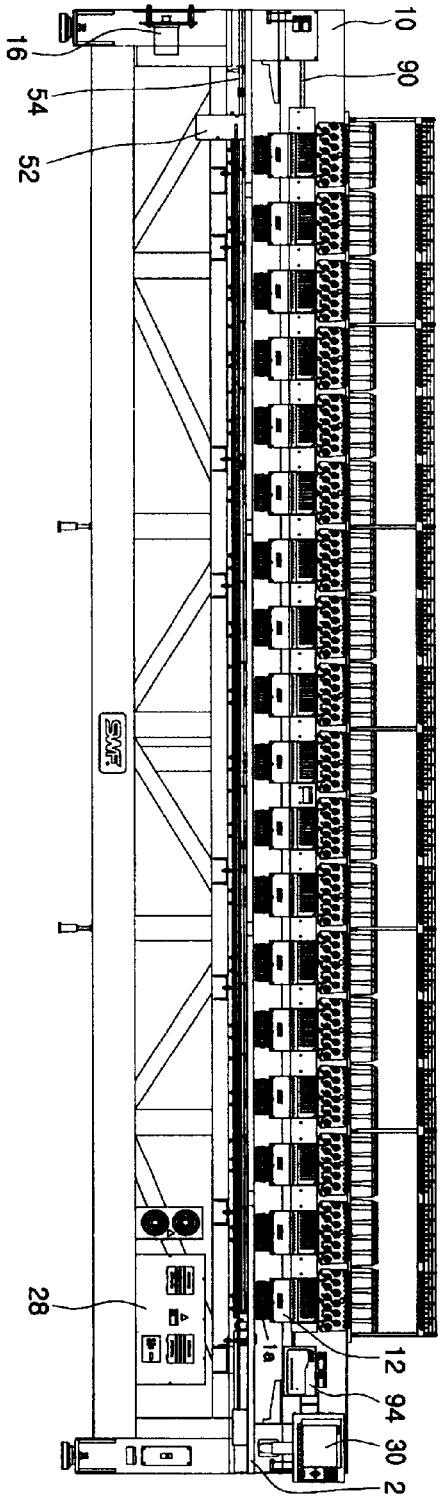
FIG. 1 shows a front view of an embroidery machine according to an embodiment of the invention.
Figure 2:
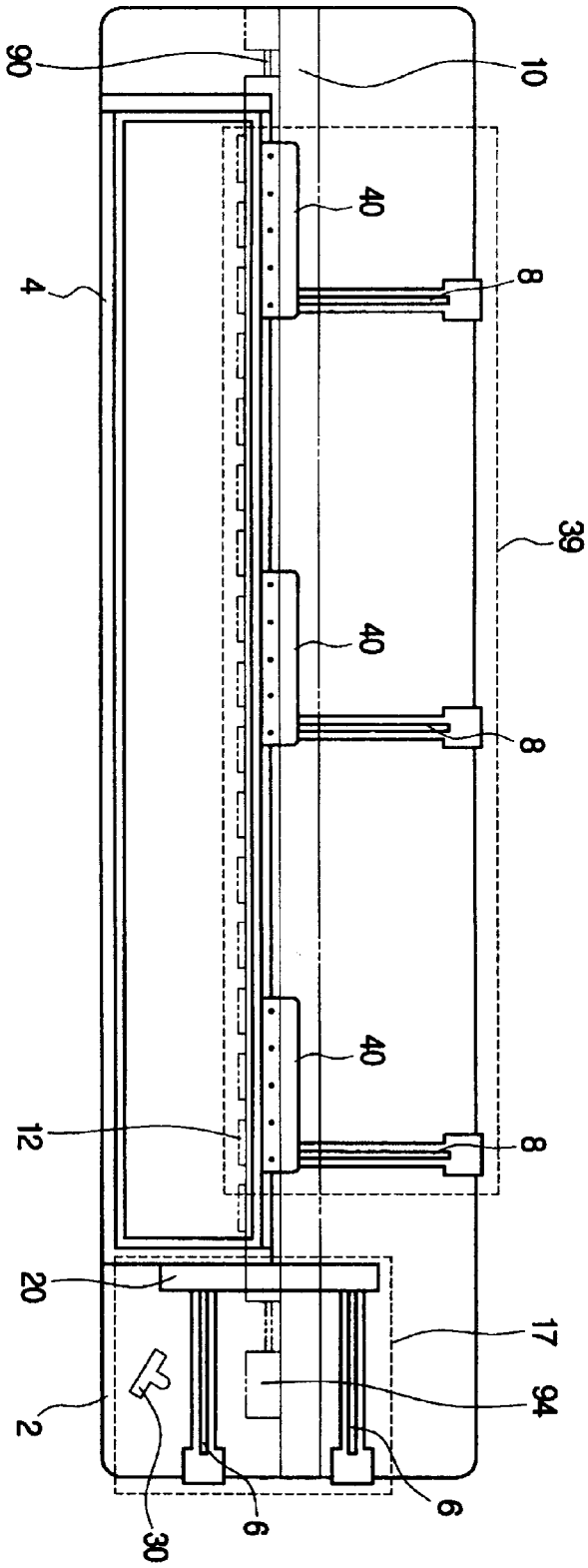
FIG. 2 shows a plan view of the embroidery machine according to the embodiment of the invention.

As shown in FIG. 1 and FIG. 2, an embroidery machine of the invention comprises a rectangular table 2 and an embroidery frame 4 located above the table 2. An X-axis slot 6 which guides the embroidery frame 4 so as to move in X direction is formed in a certain distance along a longitudinal direction on one side of the table, and a Y-axis slot 8 which guides the embroidery frame 4 so as to move in Y direction is formed in a certain distance along the longitudinal direction on a rear part of the table 2.

A beam 10 extends from one end portion to the other end portion of the table 2 in the center above the embroidery frame 4, a desired number of heads 12 including a plurality of needles are arranged apart in a constant distance each other on the beam 10, a main-shaft driver unit 16 which is located on the other side below the table 2 and provides power is coupled with the head 12.

Figure 3:
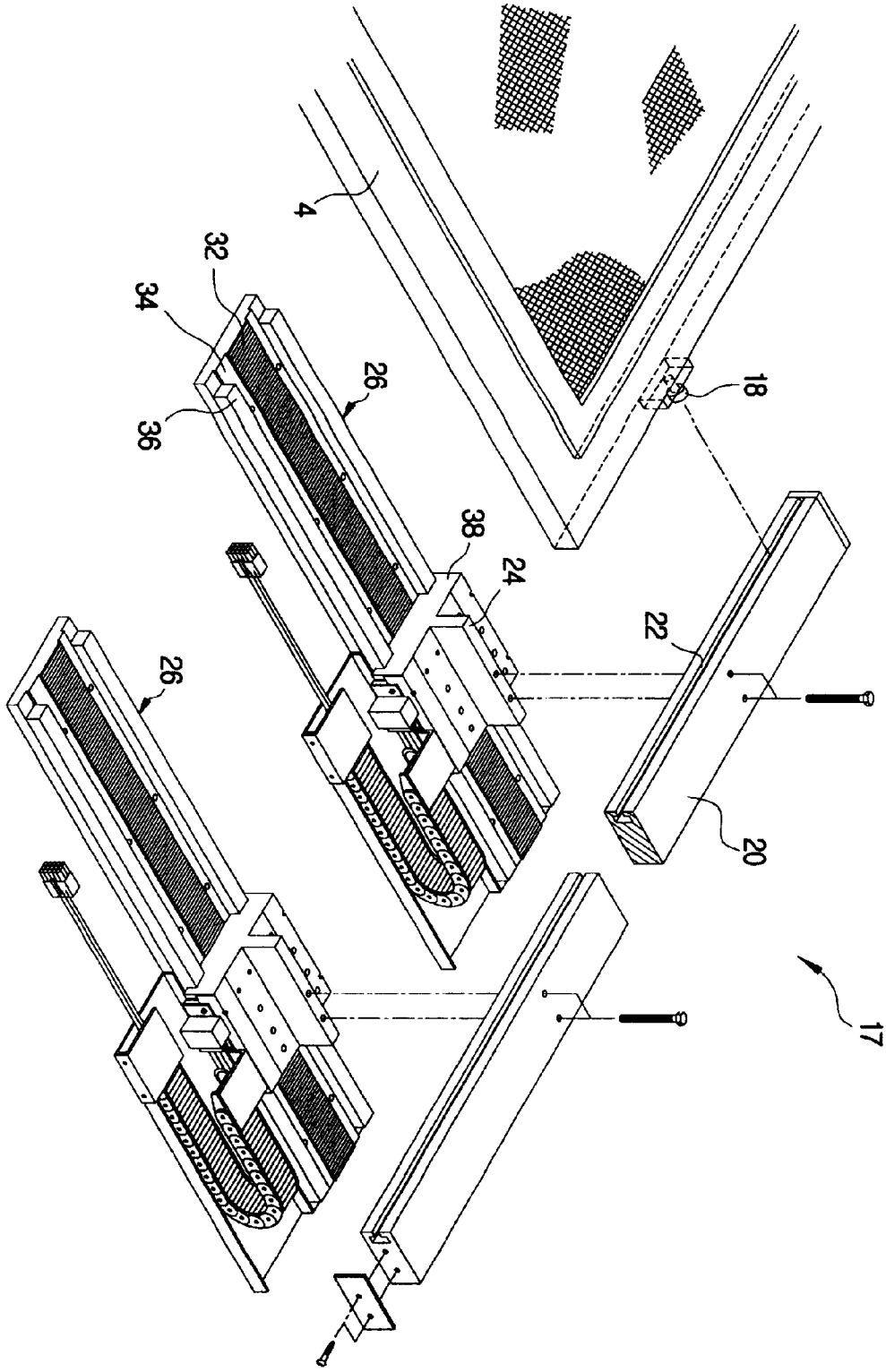
FIG. 3 shows a fragmentary perspective view of an X-axis driver unit according to the embodiment of the invention.
Figure 4:
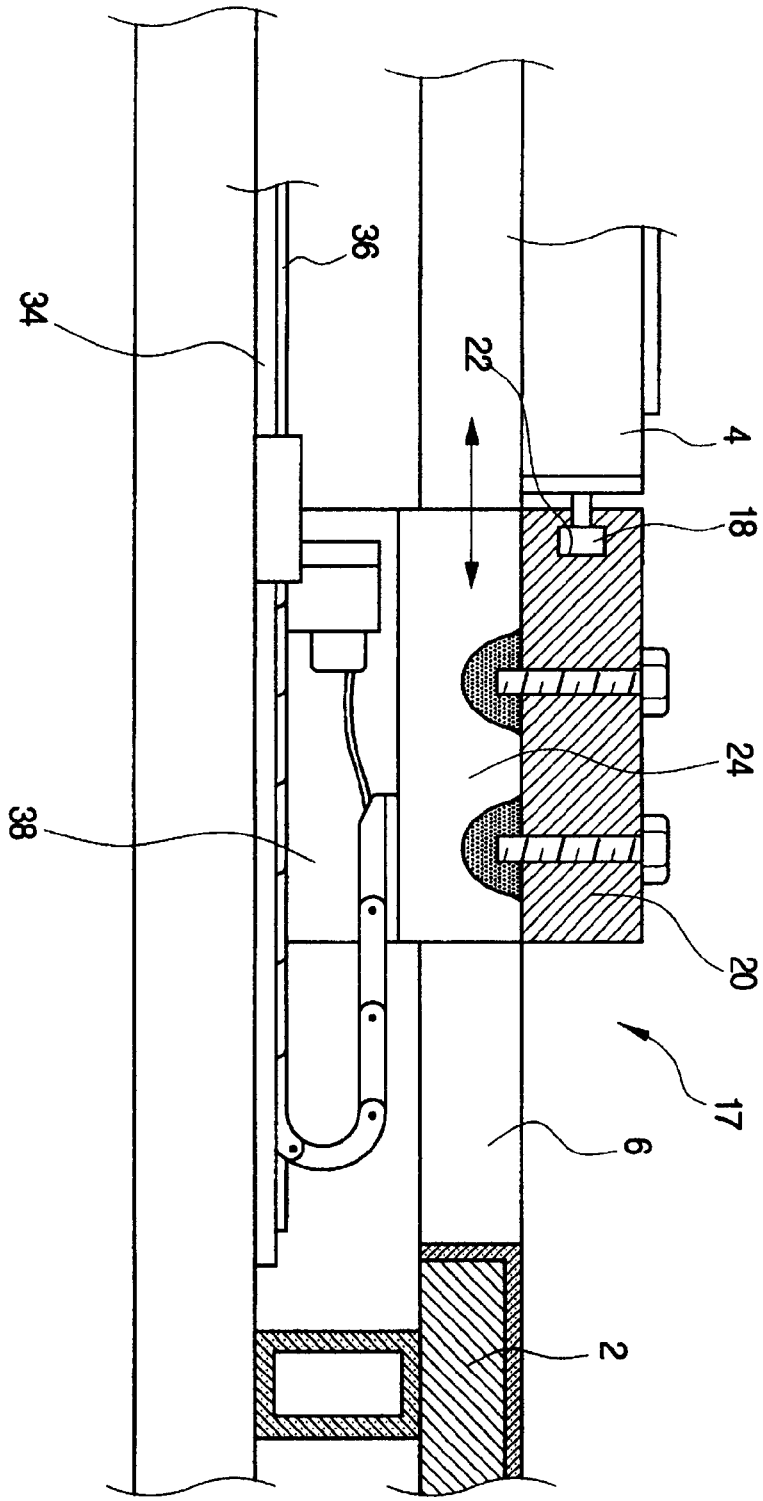
FIG. 4 shows a section view of the X-axis driver unit in combination according to the embodiment of the invention.

In addition, an X-axis driver unit 17 for providing power to move the embroidery frame 4 forward and backward in X direction is mounted on one end portion of the embroidery frame as shown in FIGS. 3 and 4, and the X-axis driver unit 17 is described in detail below.

First, the X-axis driver unit 17 comprises a roller 18 mounted rotatably on one end portion of the embroidery frame 4, and a front part of a connector frame A 20 coupled with the roller 18 for moving the embroidery frame 4 in X direction. A guide groove 22 for guiding the roller 18 to move slidingly in Y direction is formed on a front face of the connector frame A 20 along the longitudinal direction.

An upper end portion of a supporter 24 which slides in the X-axis slot 6 is coupled with the lower part of the connector frame A 20, a linear motor 26 for providing power to move the embroidery frame 4 in X direction is mounted on the lower end portion of the supporter 24, and a control unit 28 for transmitting commands is connected to the linear motor 26. While, the control unit 28 is installed below the table 2.

An operating panel 30 provided for selecting menus to embroider various colors and patterns is connected to the control unit 28.

The linear motor 26 includes various types, though, a structure of the linear motor 26 of the most appropriate type for the embodiment of the invention is as follows.

First, the linear motor 26 comprises a rack base 34 having a magnet 32 along the longitudinal direction, each rail 36 which serves as a guide is mounted on both sides of the rack base 34 respectively, and a slider 38 moving back and forth is mounted slippingly on the rail 36. In addition, a coil, not shown, for generating a magnetic field by the provided current is installed on the bottom of the slider 38 and opposite to the magnet.

It is also possible to install the X-axis driver unit 17 constructed as such at the other side of the embroidery frame 4 as necessary.

Figure 5:
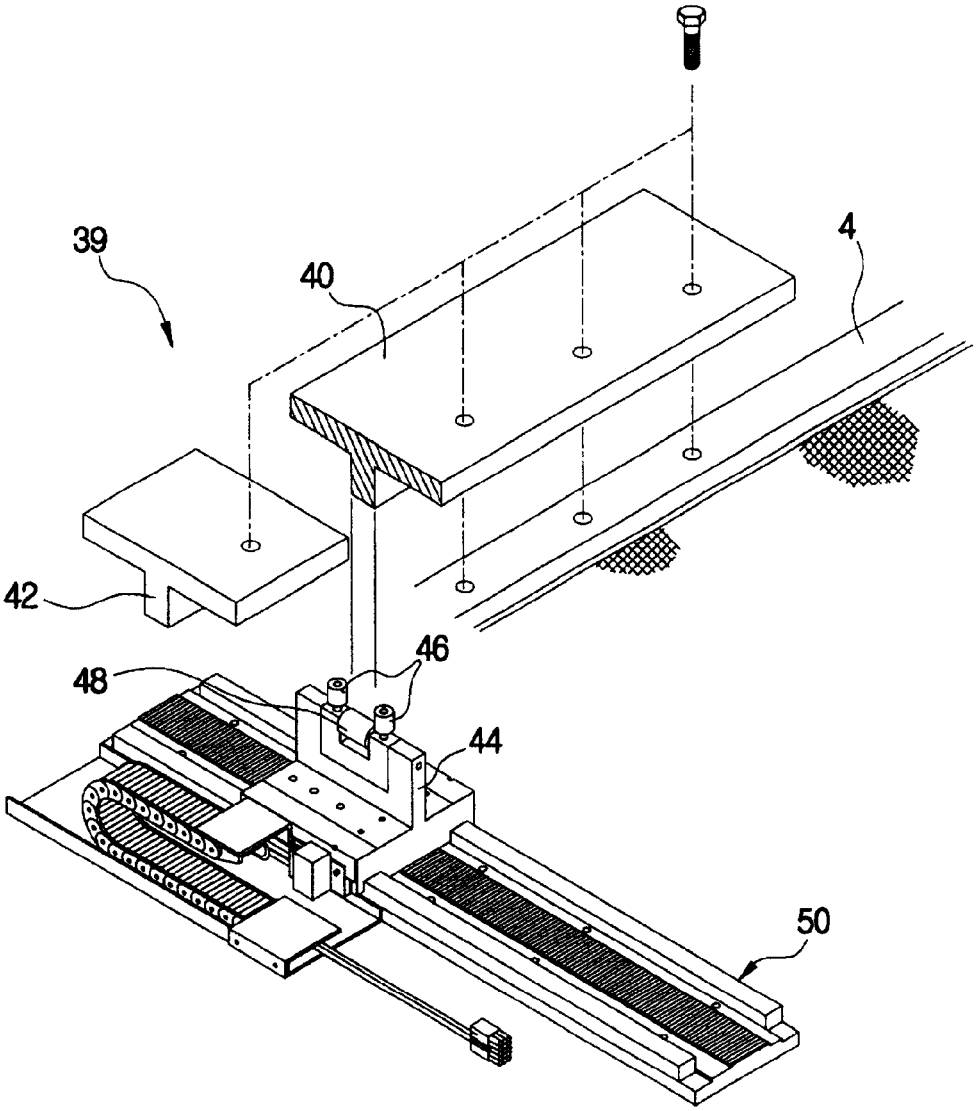
FIG. 5 shows a fragmentary perspective view of a Y-axis driver unit according to the embodiment of the invention.
Figure 6:
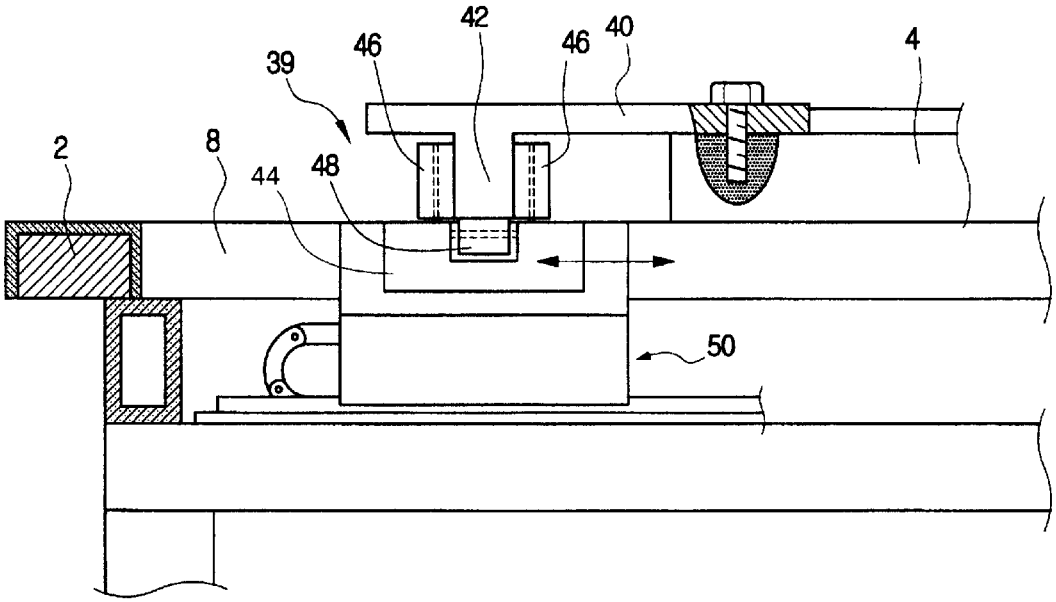
FIG. 6 shows a section view of the Y-axis driver unit in combination according to the embodiment of the invention.

In the mean while, a Y-axis driver unit 39 for moving the embroidery frame 4 forward and backward in Y direction is installed on the rear part of the embroidery frame 4 as shown in FIG. 5 and FIG. 6, the structure of the Y-axis 39 is as follows.

The Y-axis driver unit 39 comprises a connector frame B 40 installed at the rear part of the embroidery frame 4, and a slide rib 42 formed vertically on the rear face of the connector frame B 40 along the longitudinal direction.

A supporter 44 moving forward and backward along the Y-axis slot 8 is located at the lower end portion of the connector frame B 40, two guide rollers 46 which slippingly contact with the slide rib 42 and serve as a guide are mounted on both sides of the upper end portion of the supporter 44, a support roller 48 for supporting the lower end portion of the slide rib 42 and serving as a guide is installed between the guide rollers 46.

In addition, a linear motor 50 for providing power to move the embroidery frame 4 in Y direction is installed at the lower end portion of the supporter 44, while the structure of the linear motor 50 is the same as that of the above-mentioned linear motor 26.

In the meanwhile, it is possible to install the Y-axis driver unit 39 constructed as such at the front end portion of the embroidery frame 4 as necessary.

Figure 7:
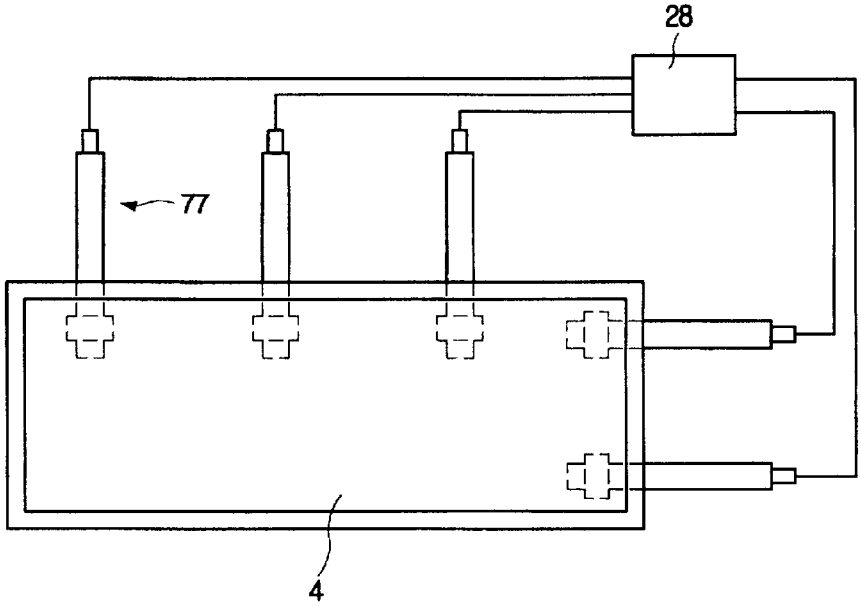
FIG. 7 shows a schematic plan view of an embroidery frame into which a mono-axis table is installed according to another embodiment of the invention.

In another embodiment to move the embroidery frame 4 in X and Y directions, mono-axis tables 77(model HS of NSK Co., in Korea) with a structure different from the linear motors 26, 50 can be installed in the X-axis driver unit 17 and the Y-axis driver unit 39 at one side and rear part of the embroidery frame 4 as shown in FIG. 7.

Figure 8:
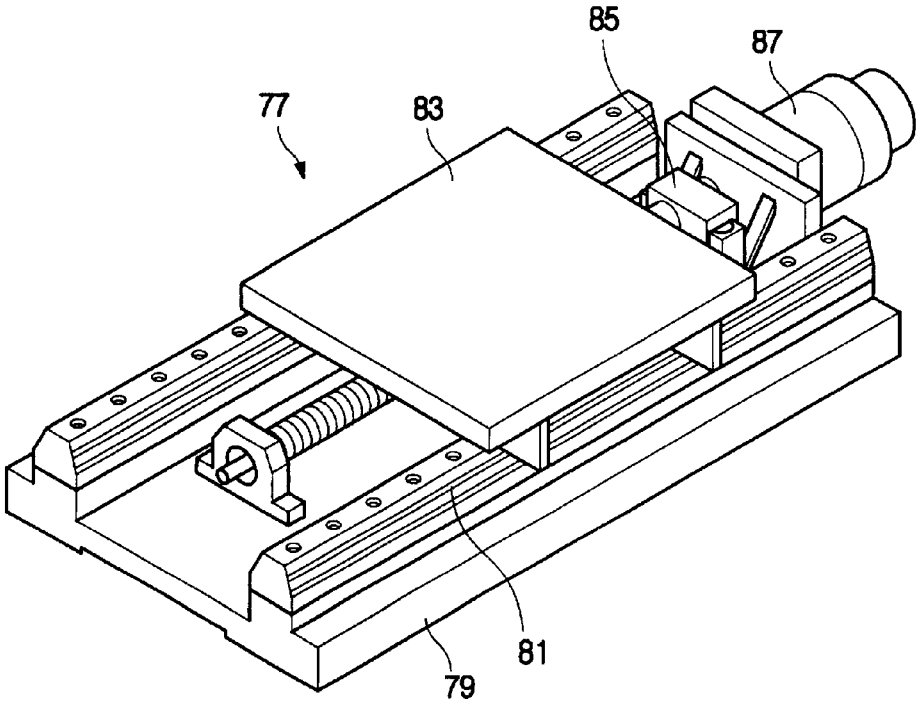
FIG. 8 shows a perspective view of the mono-axis table according to the embodiment of the invention.

The structure of the mono-axis table 77 installed as such is described below with reference to the FIG. 8.

First, the mono-axis table 77 comprises a base 79 fixed to the table 2, two beds 82 mounted respectively on the both sides of the base 79 along the longitudinal direction for serving as a guide, and a palette 83 moving forward and backward and mounted slidingly on the bed 81.

In addition, a screw 85 engaging with the lower part of the palette 83 is installed between the beds 81, a motor 87 for providing power is coupled with the rear end portion of the screw 85, and the control unit 28 for controlling the operation of the motor 87 is connected to the motor 87.

Figure 9:
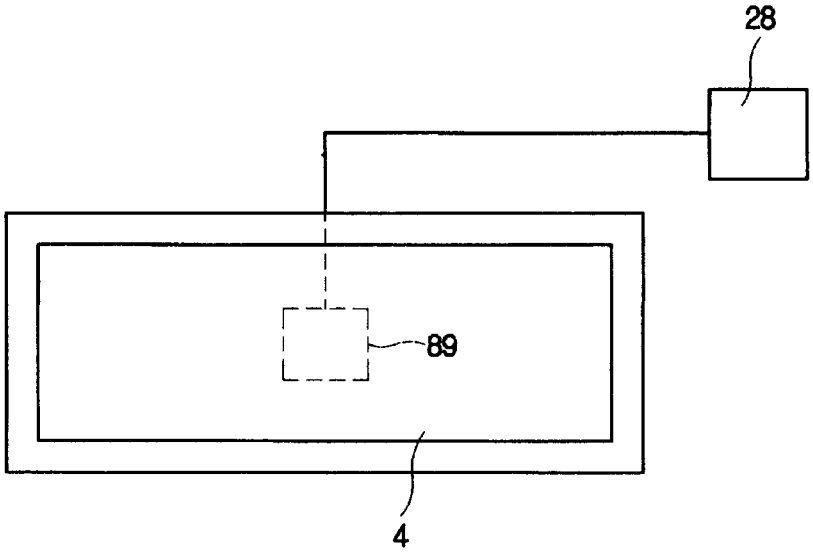
FIG. 9 shows a schematic plan view of an embroidery frame into which an XY-system is installed according to still another embodiment of the invention.
Figure 10:
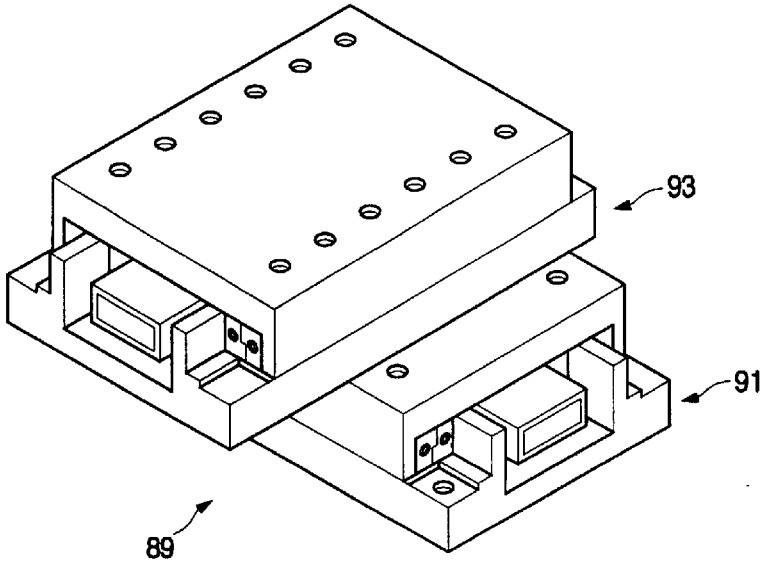
FIG. 10 shows a perspective view of the XY-system according to the embodiment of the invention.

In still another embodiment to move the embroidery frame 4 in X and Y directions, XY-system 89(model JTM-C type of JUSTEK Co.) can displace other units at the central portion of the rear face of the embroidery frame 4 as shown in FIG. 9, the structure of the XY-system 89 is described below with reference to the FIG. 10.

First, the XY-system 89 comprises an X-axis linear motor 91 which is fixed on the table 2 and provides power to move the embroidery frame 4 in X direction, and a Y-axis linear motor 93 installed above the X-axis linear motor 91 for providing power to move the embroidery frame 4 in Y direction. And the embroidery frame 4 is located on the Y-axis linear motor 93.

The control unit 28 for transmitting commands is connected to the XY-system 89.

Figure 11:
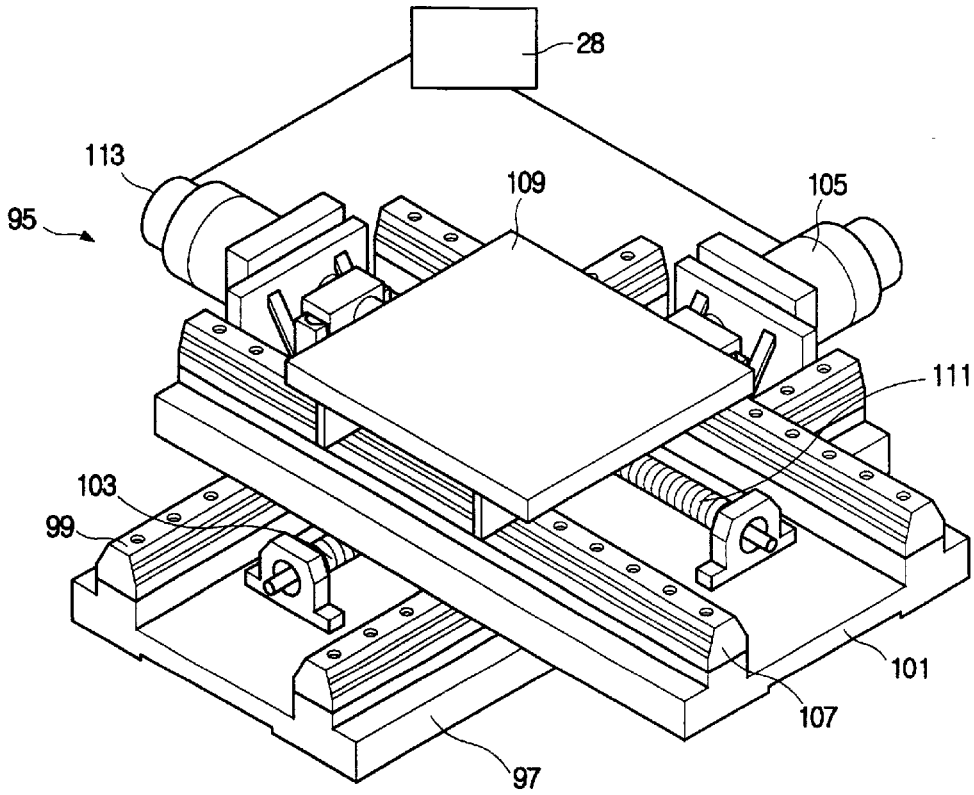
FIG. 11 shows a perspective view of the XY-table according to still another embodiment of the invention.

Further, in still another embodiment to move the embroidery machine 4 in X and Y directions, XY-table 95(model HD of NSK Co., in Korea) can displace other units at the central portion of the rear face of the embroidery frame 4 as shown in FIG. 11, the structure of the XY-table 95 is described below with reference to the FIG. 11.

First, the XY-table 95 comprises a lower base 97 fixed on the table, each bed 99 serving as a guide is mounted respectively on the both sides of the lower base 97, and an upper base 101 moving slidingly along the longitudinal direction of the bed 99 is slippingly mounted on the bed 99.

In addition, a screw A 103 engaging with the lower part of the upper base 101 is installed between the beds 99, a Y-axis motor 105 for providing power is coupled with the rear end portion of the screw A 103.

Furthermore, each bed 107 serving as a guide is mounted on both sides of the upper base 101 along the longitudinal direction, and a palette 109 sliding on the beds is installed on the beds 107. A screw B 111 engaging with the lower part of the palette 109 is installed between the beds 107, an X-axis motor 113 for providing power is coupled with the rear end portion of the screw B 111.

Also, the control unit 28 for transmitting commands is connected to the X-axis motor 113 and Y-axis motor 105 respectively.

Figure 12:
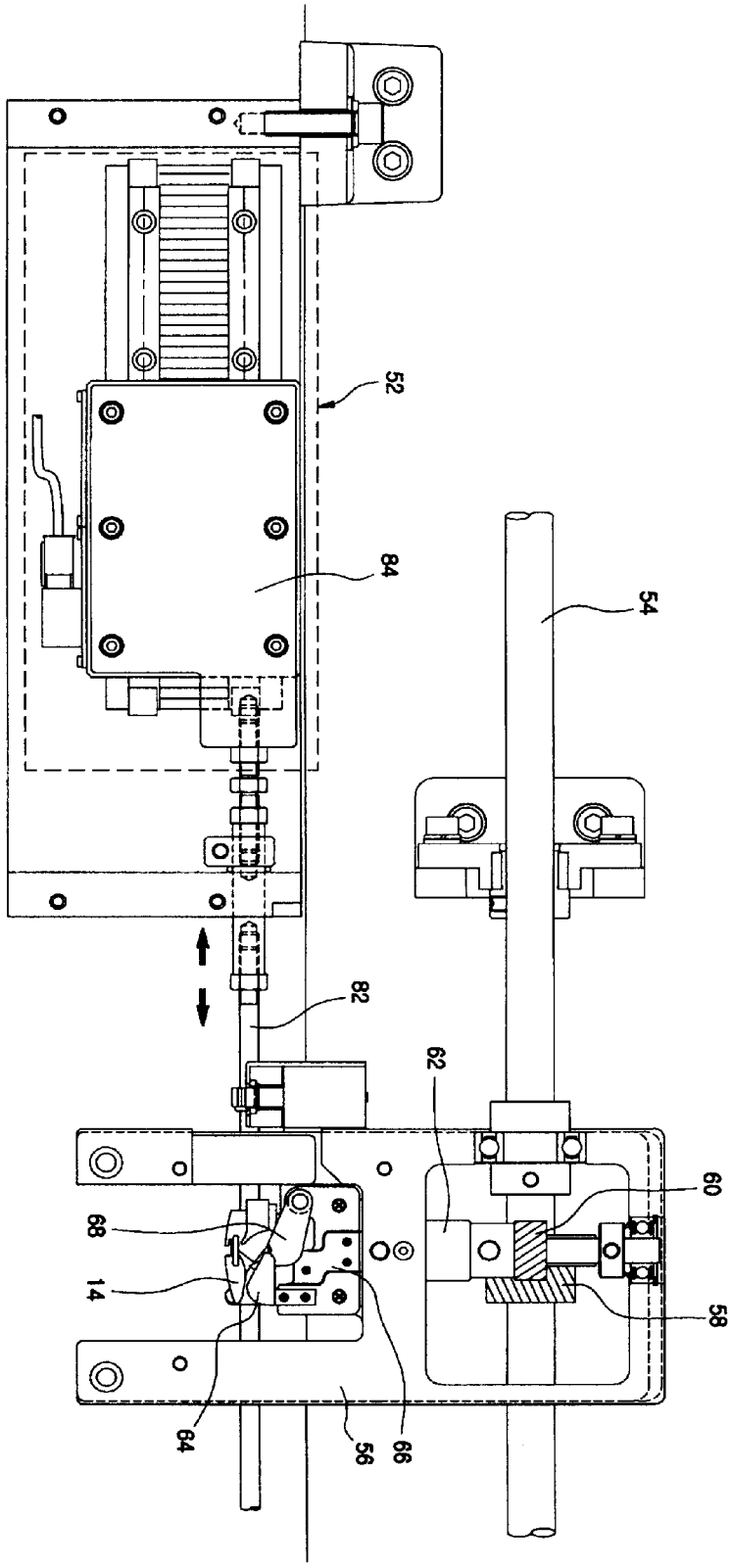
FIG. 12 shows a plan view of a thread-cut unit according to an embodiment of the invention.
Figure 13:
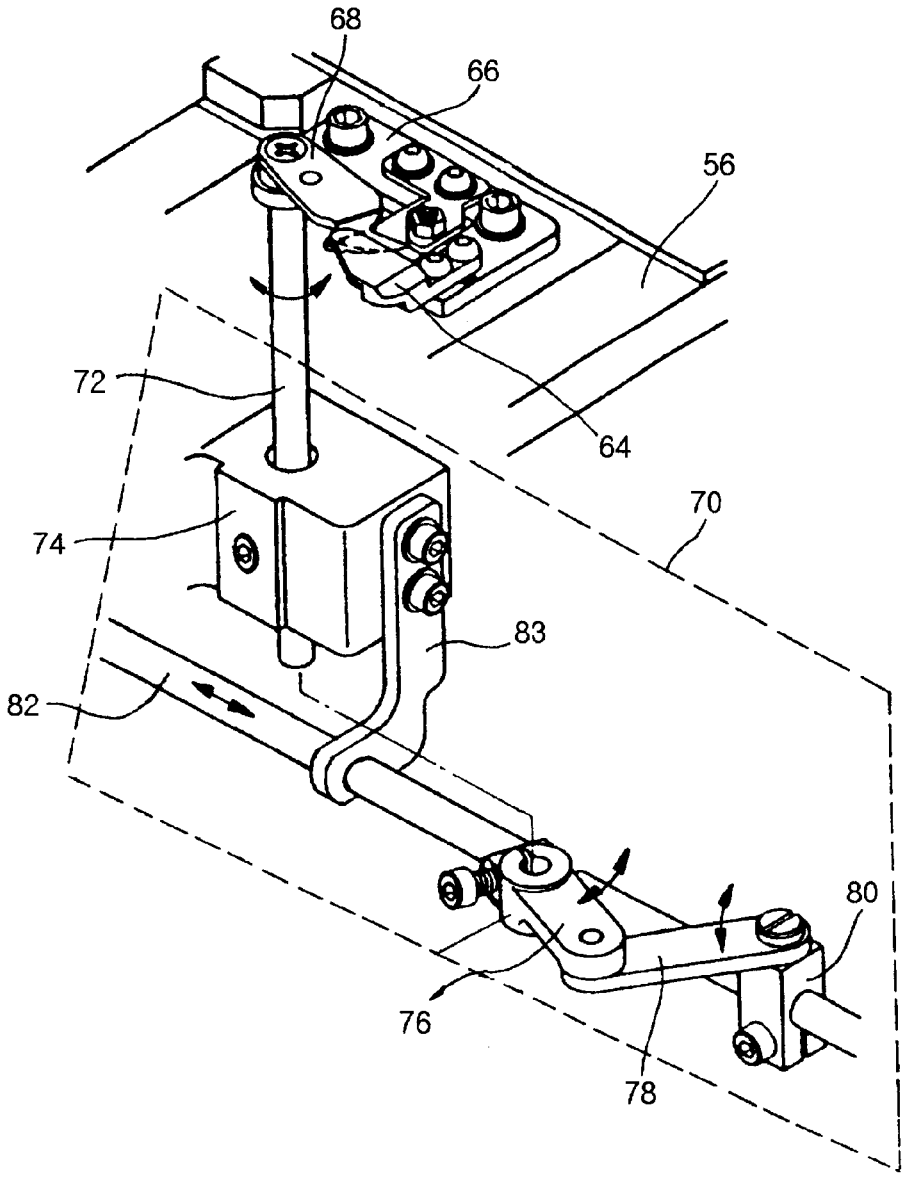
FIG. 13 shows a perspective view of the thread-cut unit according to the embodiment of the invention.

A thread-cut unit 52 for cutting an unnecessary lower thread fed from the head 12 and the hook 14 is located below the table, the structure of the thread-cut unit 52 is described below with reference to the FIG. 12 and FIG. 13.

First, there is provided a shaft 54 rotated by the power transmitted from the main-shaft driver unit 16, a rear part of a hook base 56 is coupled with the shaft 54 below the table 2 where the heads are arranged, and a driver gear 58 formed with a helical gear is located inside the hook base 56 and engages with the shaft 54.

Then, a follower gear 60 coupled with the driver gear 58 in gear engagement is engaged with a shaft 62 which is installed rotatably at the hook base 56, the hook 14 is coupled with the front end portion of the shaft 62 so as to rotate together, a cutter 64 for holding the unnecessary lower thread to be cut has a blade at its front end portion and is installed at a plate 66 mounted on the hook base 56, above the hook 14.

Also, a cutter 68 for cutting the lower thread while rotating has a blade at its front end portion and is located crosswise, a power transmission unit 70 for providing power to cut the lower thread is installed at the cutter 68, while a thread-cut shaft 72 constituting the power transmission unit 70 is installed vertically at the rear end portion of the cutter 68.

The lower part of the thread-cut shaft 72 is rotatably coupled to a lug 74 installed inside the hook base 56, link 76 and link 78 which transmit rotatory force are rotatably coupled with the lower end portion of the thread-cut shaft 72 in sequence, and a upper end portion of a clamp 80 is coupled with the rear end portion of the link 78.

A thread-cut driver unit 52 for providing power for the cutter 68 to perform the cutting operation is installed at the rear part of the rod 82, the thread-cut driver unit 52 comprises a linear motor 84 having the same structure as the linear motor 26 installed at the above-mentioned X-axis driver unit 17 and Y-axis driver unit. Also, the control unit 28 for transmitting commands is connected to the linear motor 84.

On the contrary, the mono-axis table 121 which will be described below can be installed at the thread-cut driver unit 52 instead of the linear motor 84.

Figure 14:
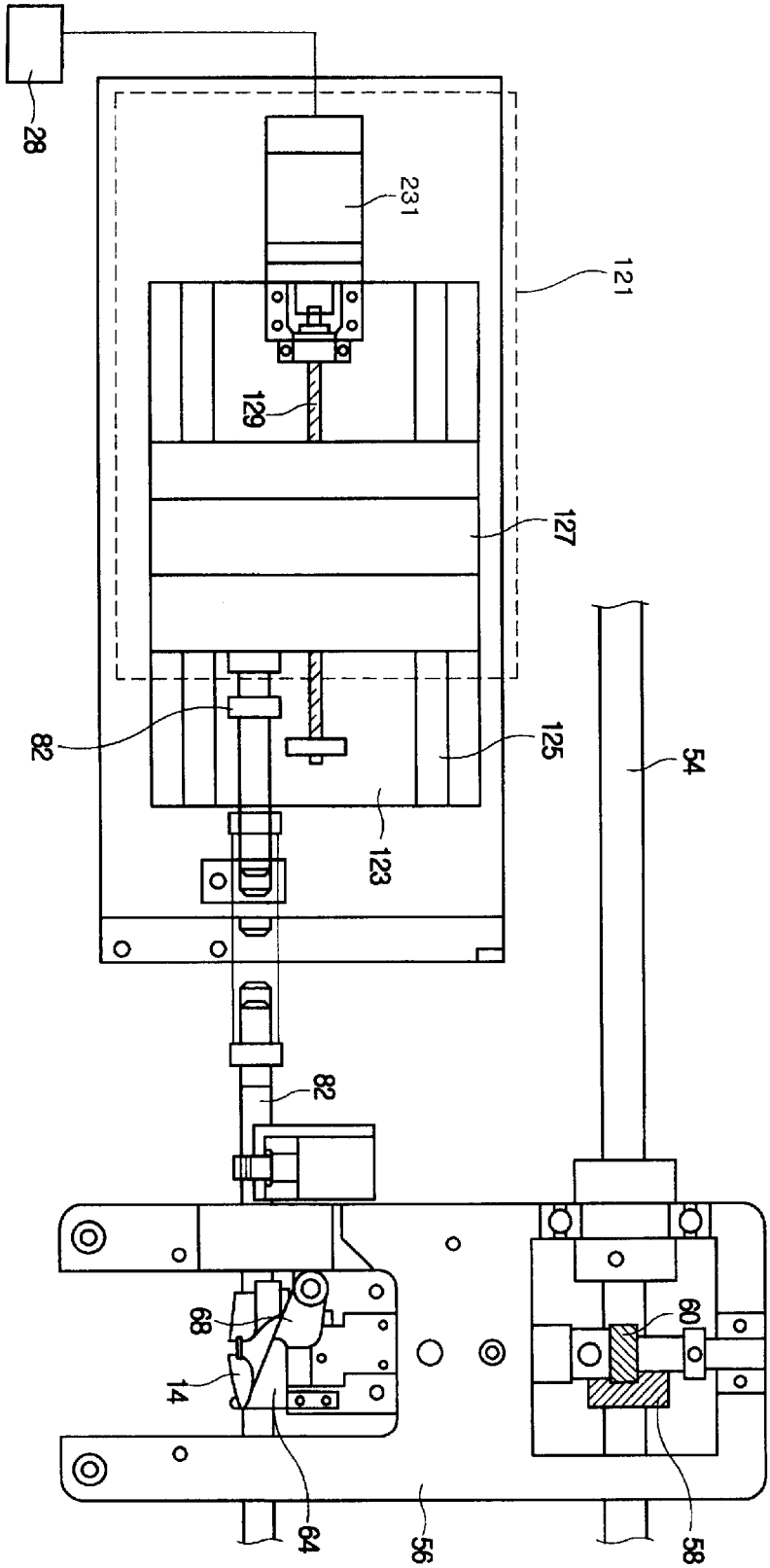
FIG. 14 shows a plan view in which another embodiment of the invention is installed into a thread-cut unit.

In the structure of the mono-axis table 121 shown in FIG. 14, two beds 123 are mounted on both sides of the base along the longitudinal direction, a palette 127 is slidingly mounted on the beds 125, the rod 82 is coupled with the front face of the palette 127. Further, a screw 129 is screwed into the rear face of the palette 127, a motor 231 for providing force is coupled with the rear end portion of the screw 129, a control unit 28 for transmitting commands is connected to the motor 231.

Figure 15:
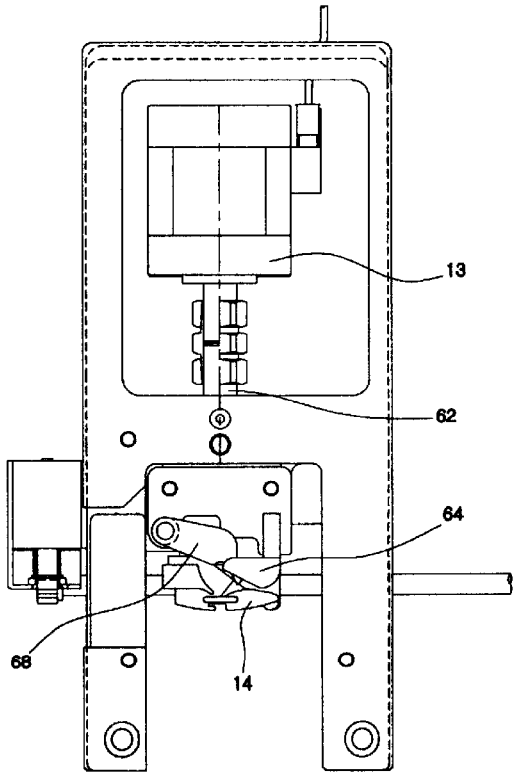
FIG. 15 shows a plan view of a power transmission unit of a hook of the invention.

Alternatively, another embodiment to rotate the hook 14 is described below with reference to the FIG. 15.

First, a hook 14 is installed inside the hook base 56 as described above, a front end portion of a shaft B 62 for transmitting power is coupled with the hook 14, a small-sized motor for providing power is coupled with the rear part of the shaft B 62, the control unit 28 for transmitting commands is connected to the small-sized motor 13.

Figure 16:
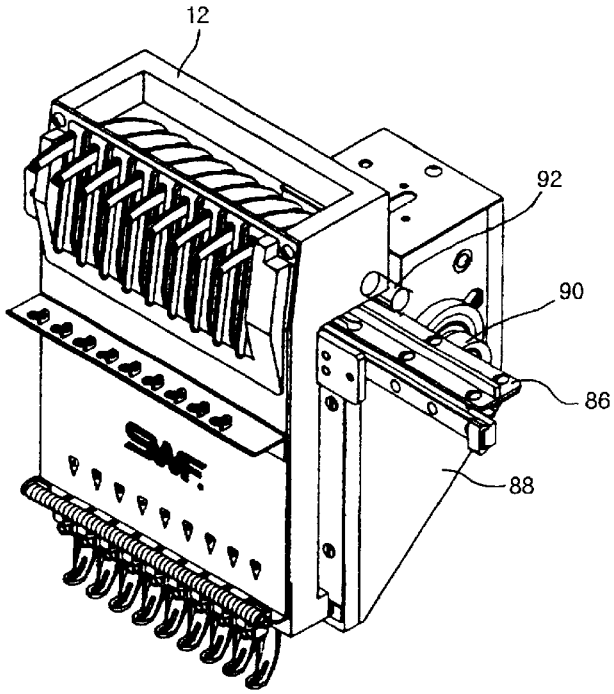
FIG. 16 shows a perspective view of a head according to the embodiment of the invention.

In the meanwhile, a plurality of arms 88 are mounted on the front face of the beam 10 and spaced apart each other, a shaft C 90 rotated by the power provided from the main-shaft driver unit 16 is coupled with the arm 88 as shown in FIG. 16, a rail 86 serving as a guide is installed at the front upper end portion of the arm 88. Also, a head 12 moving transversely is slidingly coupled with the rail 86.

Figure 17:
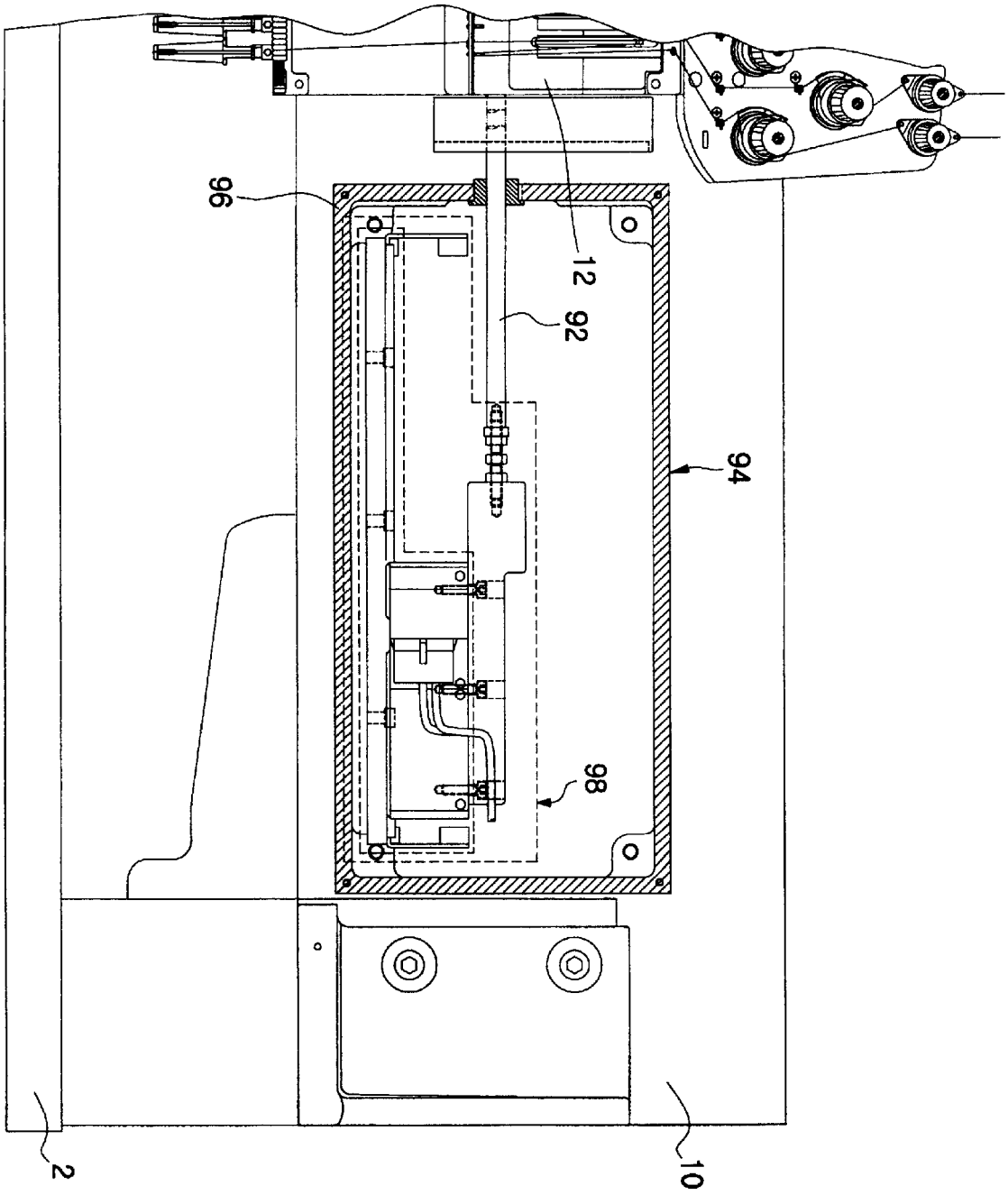
FIG. 17 shows an installed state in which the embodiment of the invention is installed into a color-change driver unit.

In addition, a front end portion of the rod 92 for transmitting force so as to move the head 12 leftward and rightward is coupled with one end portion of the head 12, a color-change driver unit 94 for adjusting the head so as to embroider in various colors is installed at the rear end portion of the rod 92 as shown in FIG. 17.

The color-change driver unit 94 comprises a housing 96 fixed to the beam 10, a linear motor 98 with the same structure as the above-mentioned linear motor 26 is installed inside the housing 96. A rear end portion of the rod 92 is coupled with the linear motor 98, and the control unit 28 for transmitting commands is connected to the linear motor 98.

Alternatively, the above-mentioned mono-axis table 131 can be installed inside the housing 96 instead of the linear motor 98.

Figure 18:
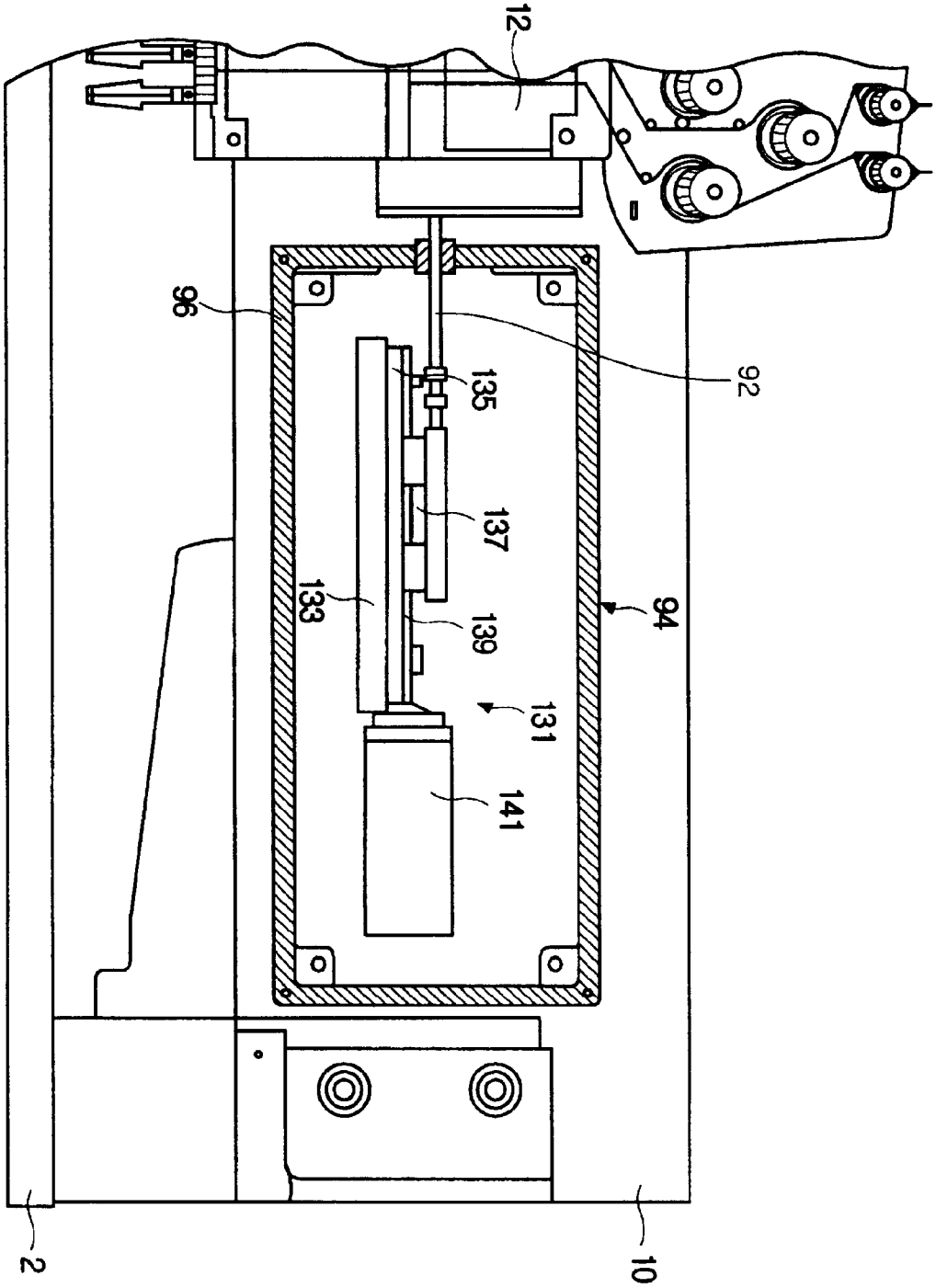
FIG. 18 shows an installed state in which a mono-axis table according to another embodiment of the invention is installed into the color-change driver unit.

In the structure of the mono-axis table 131 shown in FIG. 18, each bed 135 is mounted respectively on both sides of the base 133 along the longitudinal direction, a palette 137 is mounted on the beds 135, the rod 92 is coupled with the front end portion of the palette 137.

In addition, a screw 139 is screwed into the rear face of the palette, a motor 141 for providing power is installed at the rear end portion of the screw 139, and the control unit 28 for transmitting commands is connected to the motor 141.

Figure 19:
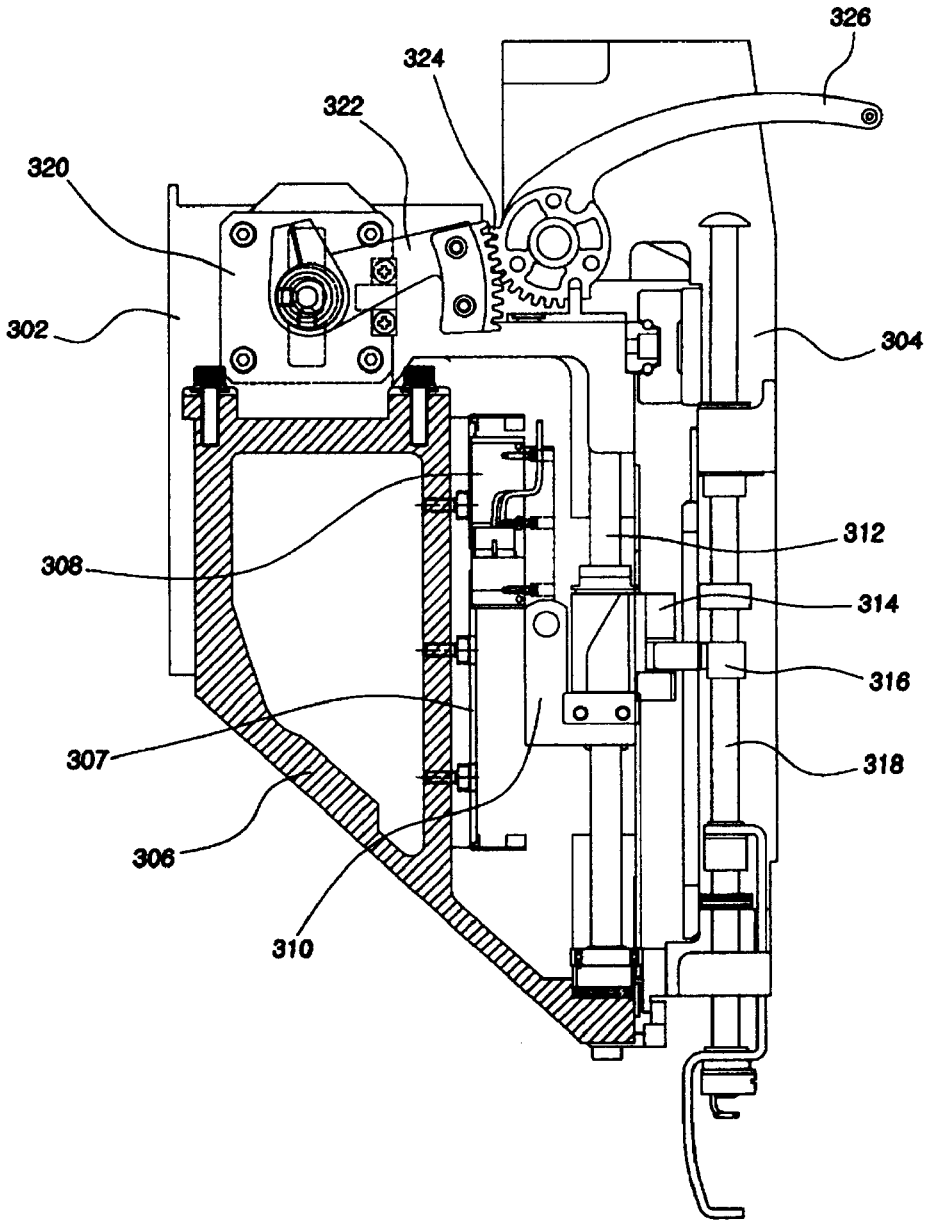
FIG. 19 shows a section view of a head of the invention.

While, an arm 302 fixed to the front face of the beam 10, and a head 304 slidingly coupled to the upper part of the head and transversely movable are installed in the head such as those shown in FIG. 19. And, the constitution of the invention for feeding a single thread to the thread is as follows.

First, an inner frame 306 with a guide rail 307 at its front face is installed inside the arm 302, a linear motor 308, i.e. vertical driver means connected to the control unit 28 is installed at the front face of the inner frame 306. A slider 310 which moves up and down and is coupled with a needle holder control block 314 is installed at the linear motor 308, a needle holder shaft 312 serving as a guide is slippingly coupled with the needle holder control block 314 and installed vertically at the arm 302.

A fixed bracket 316 which can be inserted or removed is installed at the center of the needle holder control block 314, and a needle holder 318 is coupled with fixed bracket 316 so as to move up and down therewith. At this time, the needle holder 318 is installed so as to move up and down within the head 304.

In addition, a reversible motor 320 which provides power and is connected to the control unit 28 is installed at the upper end portion of the inner frame 306, a driver lever 322 with a sector gear at its one end portion is installed at the reversible motor 320, and a driver gear 324 is engaged with the sector gear of the driver lever 322 and rotatably installed at the head 304. A thread-snatch unit 326 that pulls a thread located above the needle holder 318 and feeds the thread to the needle holder 318 is coupled with the driver gear 324.

Figure 20:
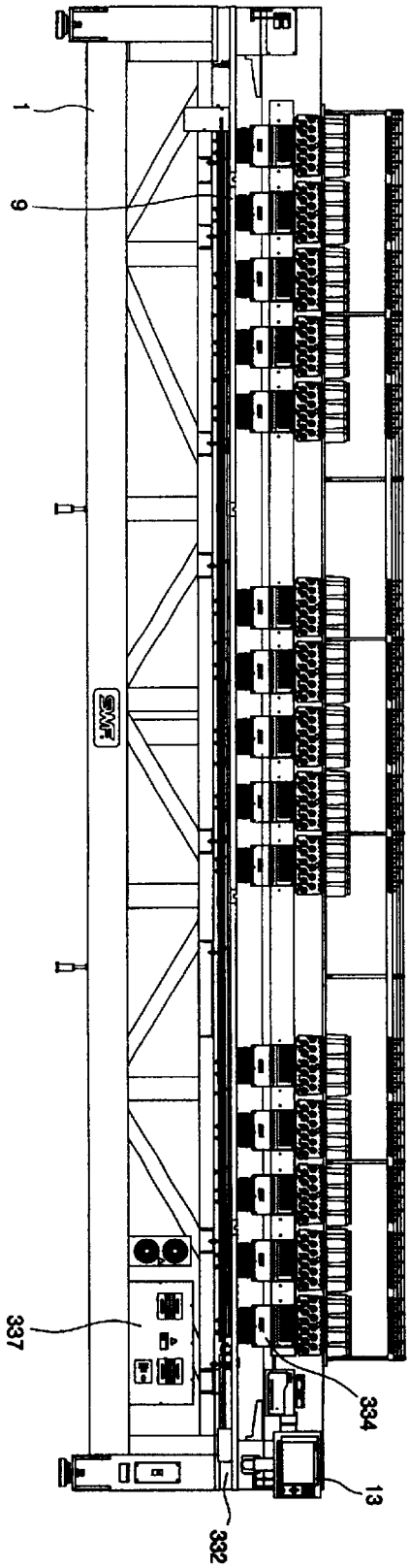
FIG. 20 shows a front view illustrating an entire appearance of a multi-head embroidery machine of an independent-drive type according to another embodiment of the invention.
Figure 21:
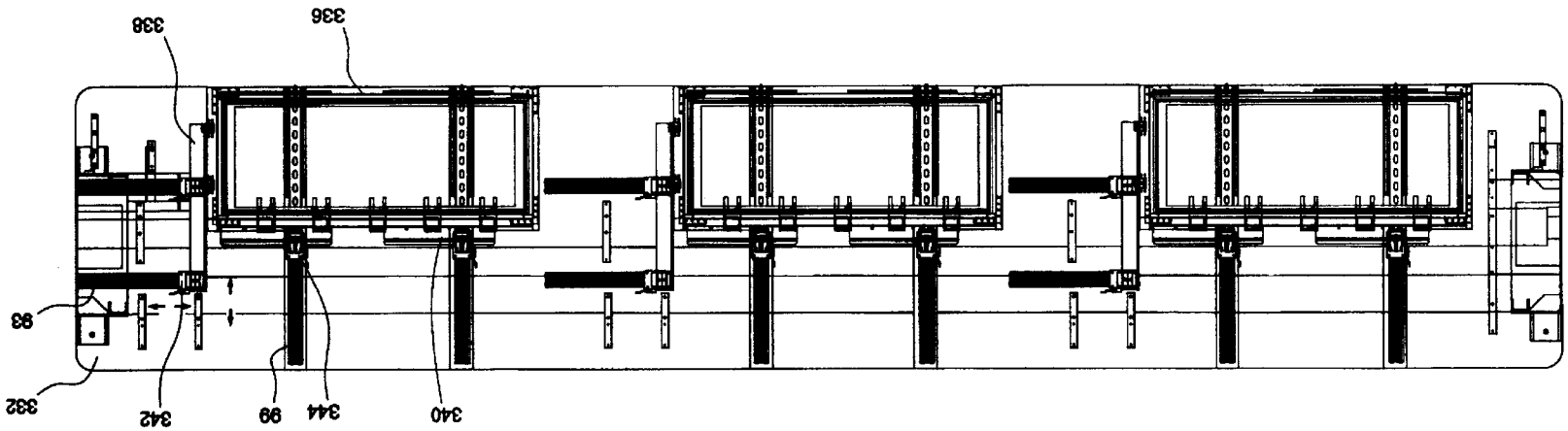
FIG. 21 shows a plan view illustrating an entire appearance of a multi-head embroidery machine of an independent-drive type according to another embodiment of the invention.
Figure 22:
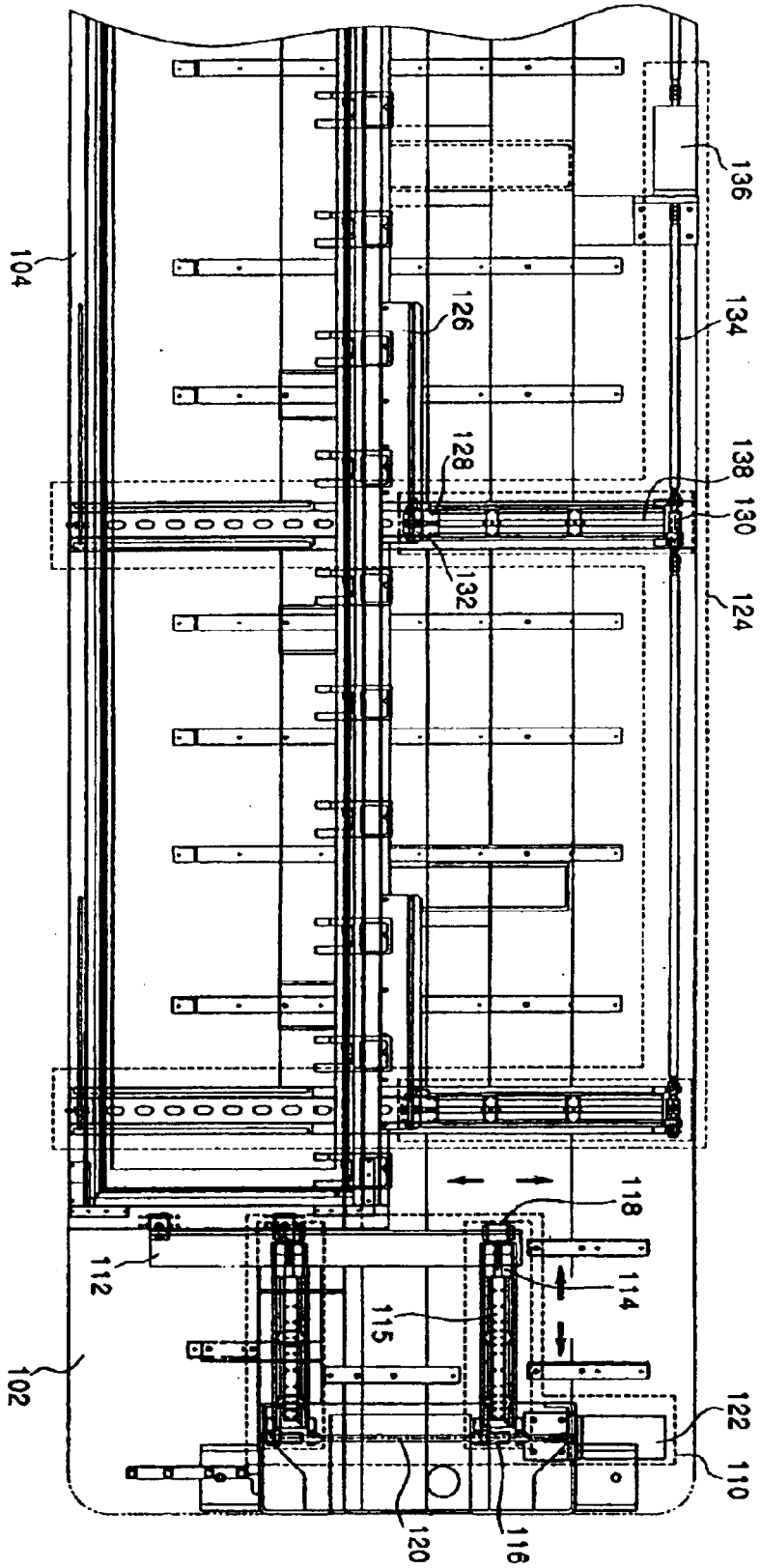
FIG. 22 shows a plan view of an embroidery machine according to a prior art.
Figure 23:
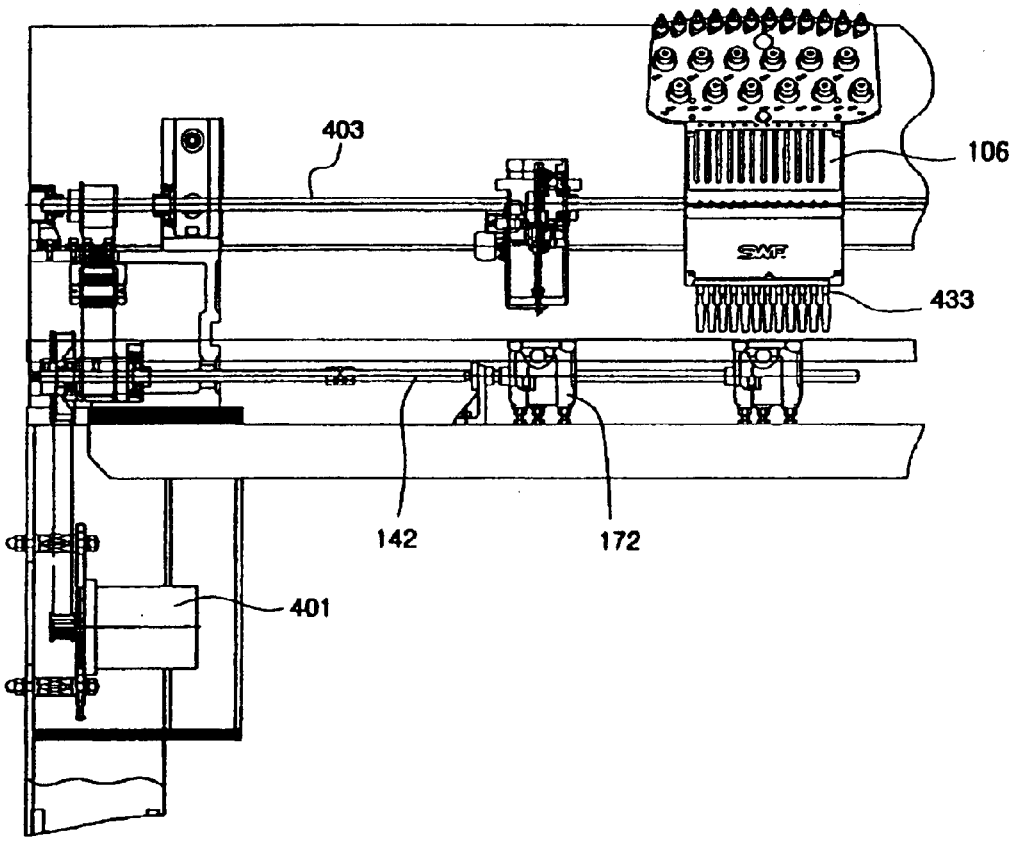
FIG. 23 shows an internal construction illustrating a head and a hook driver unit of the embroidery machine according to the prior art.
Figure 24:
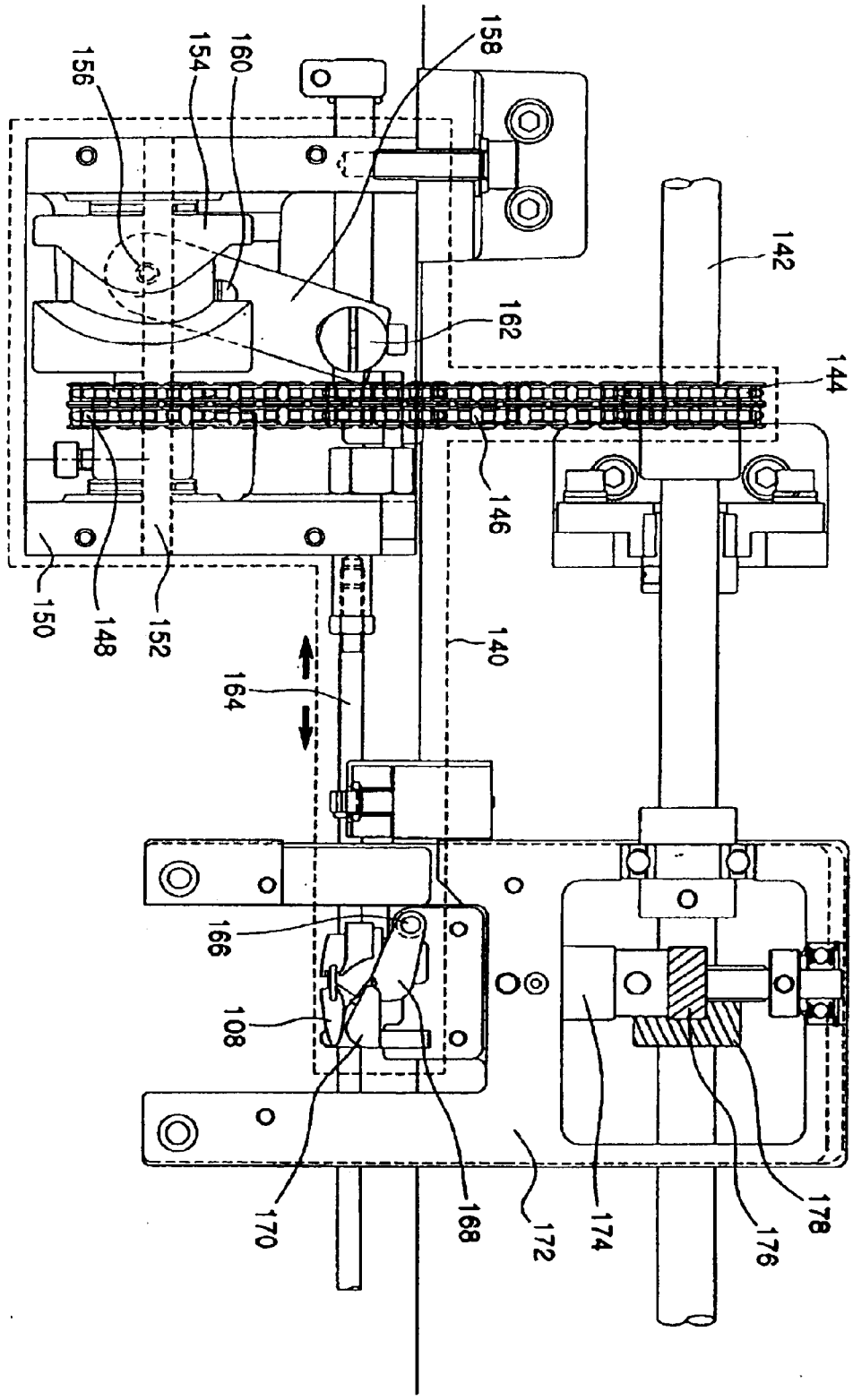
FIG. 24 shows a plan view of a thread-cut unit according to the prior art.
Figure 25:
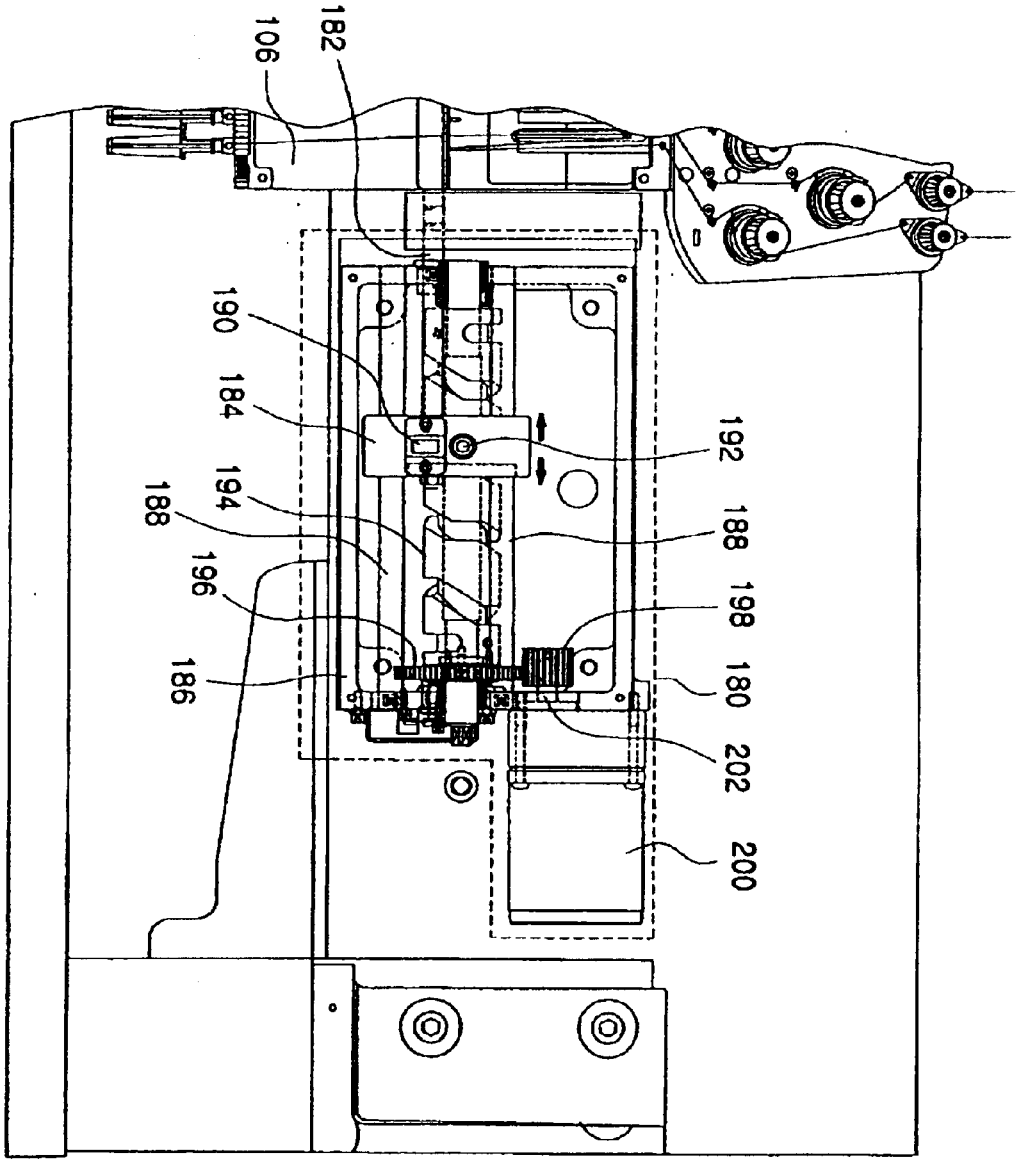
FIG. 25 shows a installation view of a color-change driver unit according to the prior art.
Figure 26:
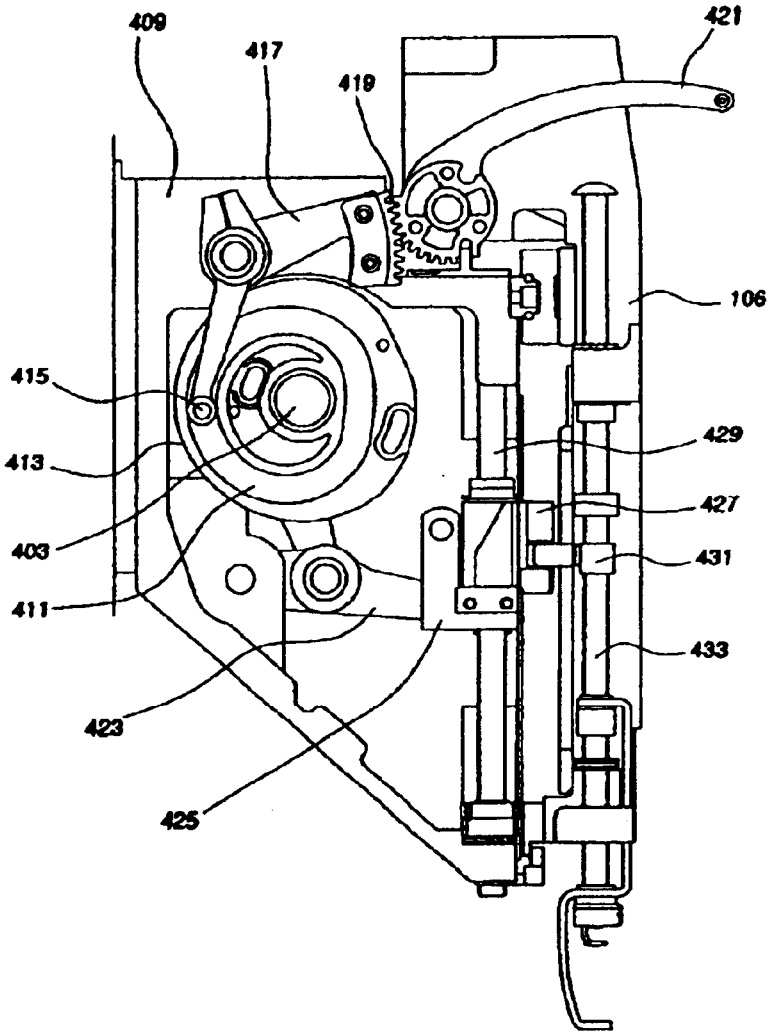
FIG. 26 shows an internal construction of a head in the embroidery machine according to the prior art.

Next, another embodiment of the invention is described below with reference to the FIG. 20 and FIG. 21.

First, five heads 334 connected to controllers 337 respectively form a head group and are installed at the upper part of a working plate 332.

Also, it is possible to set the number of the head 334 in a head group or set the head groups according to embroidery operation items. A single embroidery frame 336 is disposed in each head group.

A fixed bracket 338 is installed at one end portion of each embroidery frame 336, a linear motor 342 for providing power so as to move the embroidery frame 336 in X direction is installed at the fixed bracket 338, and the linear motor 342 is connected to the controller 337.

Next, a fixed bracket 340 is installed at the rear part of each embroidery frame 336, a linear motor 344 for providing power to move the embroidery frame 336 in Y direction is installed at the fixed bracket 340, and the linear motor 344 is connected to the controller 337.

The operation of the invention constructed as such is as follows.

First, operation items are inputted through the operating panel 30 in order to embroider various patterns on a cloth, then the control unit 28 transmits commands to the linear motors 26, 50, the main-shaft driver unit 16 and the like.

Accordingly, the control unit 28 makes the linear motor 50 remain a stationary state, and at the same time transmits an operation command to the other linear motor 26 when the embroidery frame 4 is required to move in X direction. Then, the slider 38 moves forward or backward along the rail 36 together with the supporter 24, thereby the supporter 24 moves along inside the X-axis slot 6 and causes the connector frame A 20 to move therewith.

When the connector frame A 20 moves forward or backward, then the roller 18 coupled with the guide groove 22 is pulled or pushed, thereby the embroidery frame 4 is moved in X direction on the table 2.

At the same time, the slide rib 42 moves between the guide rollers 46 at the upper end portion of the supporter 44 of the linear motor 50 and over the support roller 48, because the connector frame B 40 at the rear part of the embroidery frame 4 is at a fixed position, as a result of this, the embroidery frame 4 is guided and moved forward or backward in X direction.

The power transmitted from the main-shaft driver unit 16 when the embroidery frame moves forward and backward is transmitted to the shaft C 90 and causes the needle at the head 12 to move up and down so as to embroider the cloth.

Further, in case the embroidery frame 4 is required to change the position when embroidering as above, then the control unit 28 transmits a 'stop command' to the linear motor 26, and at the same time, transmits an 'operation command' to the other linear motor 50.

Accordingly, the linear motor 50 moves forward or backward and causes the supporter 44 to move, thereby one face of the slide rib 42 located between the guide rollers 46 is pushed or pulled and moved in Y direction together with the connector frame B 40, and at the same time the embroidery frame 4 is moved slidingly on the table 2.

When the embroidery frame 4 is moved in Y direction as such, the roller 18 located at one end portion of the embroidery frame 4 is rotated and moved in Y direction along the guide groove 22 formed on the front face of the connector frame A 20.

At this time, the connector frame A 20 remains stationary because the operation of the other linear motor 26 is stopped.

When the embroidery frame 4 moves as such, the needle at the head 12 moves up and down constantly and embroiders on the cloth as described above.

Alternatively, when the motor 87 in the mono-axis table 77 installed at the one side and rear part of the embroidery frame 4, with different structures respectively, receives a command from the control unit 28 for operation, the screw 85 is rotated and causes the palette 83 to move so that the palette 83 can slide along the bed 81.

Further, when the embroidery frame 4 is required to move in both X and Y directions, the control unit 28 transmits selectively a command to the motors 87 located respectively at one side and a rear part of the embroidery frame 4, so that the embroidery frame 4 is moved on the table 2 to embroider on the cloth as described above.

In addition, when the XY-system 89 which has a structure different from those in the above and is installed at the rear face of the embroidery frame 4 receives a command from the control unit 28, the XY-system 89 causes the embroidery frame 4 to move in X and Y directions according to a desired embroidering position. At this time, when the control unit 28 transmits a command to the X-axis linear motor 91 so as to move the embroidery frame 4 in X direction, then the Y-axis linear motor 93 in stationary state is moved forward and backward on the table 2 together with the embroidery frame 4.

Alternatively, when the control unit 28 transmits an operation command to a Y-axis linear motor 93, which causes the stationary X-axis linear motor 91 to remain current position and causes the embroidery frame 4 to move forward and backward in Y direction.

In addition, when the XY-table 95 which has a structure different from those in the above and is installed at the rear face of the embroidery frame 4 receives a command from the control unit 28, the XY-table 95 causes the embroidery frame 4 to move in X and Y directions according to the desired embroidering position.

At this time, the control unit 28 transmits an operation command to the X-axis motor 113 in order to move the embroidery frame 4 in X direction, then the screw B 111 is rotated leftwards or rightwards by the X-axis motor 113 and causes the palette 109 to move forward or backward, as a result of this, the palette 109 slides along the beds 107 and causes the embroidery frame 4 to move forward or backward in X direction on the table 2.

Alternatively, when the control unit 28 transmits an operation command to the Y-axis motor 105, the screw A 103 is rotated leftwards or rightwards and causes the upper base 101 to move forward or backward, so that the upper base 101 slides along the beds 99 together with the palette 109. Accordingly, the embroidery frame 4 located above the palette 109 is caused to move forward or backward on the table.

In the meanwhile, a part of the power transmitted to the shaft C 90 is transmitted to the shaft A 54 in turn and causes the driver gear 58 to rotate, so that the follower gear 60 engaged with the driver gear 58 is rotated with the shaft B 62 and causes the hook 14 to rotate.

As a result, the hook 14 is rotated and feeds a single thread upward, so that the single thread can be tied to another single thread moving downward along the head 12. At this time, the cutter B 68 remains stationary because the cutter B 68 did not receive the force through the power transmission unit 70.

On the contrary, in the method for rotating the hook 14 directly without the power from the main-shaft driver unit 16, when the small-sized motor 13 receives an operation command from the control unit 28, the shaft B 62 is rotated and causes the hook 14 to rotate so as to feed a single thread as described above.

In the step of embroidering on the cloth fixed to the embroidery frame 4, when a single thread of another color is required to be fed so as to form various patterns, the previously fed single thread should be cut. At this time, the control unit 28 transmits an operation command to the linear motor 84, then the rod 82 is moved forward together with the clamp 80 by the force.

Therefore, the links A and B 76, 78 are rotated by the moving clamp 80 and cause the thread-cut shaft 72 to rotate, so as to rotate the cutter B 68 therewith and push the necessary single thread away. On the contrary, when the control unit 28 transmits a command to the linear motor 84 again and causes the rod 82 to move backward, the clamp 80 is moved together with the rod 82 and causes the links A and B 76, 78 to rotate in the direction opposite to that described above.

Accordingly, the thread-cut shaft 72 is rotated reversely and returns the cutter B 68 to its original position, as a result of this, an upper thread near the needle and located outward the cutter B 68 is protected and returned to its original position, and unnecessary upper thread and lower thread near the cloth are moved toward the cutter A 64 and cut.

After the upper and lower threads are cut as such, the control unit 28 transmits a stop command to the linear motor 84 so that the cutter B 68 can be in a stationary state.

Alternatively, the operation procedure of the mono-axis table 121 coupled with the rod 82 is as follows.

First, when the motor 231 receives an operation command from the control unit 28, the screw 129 is rotated by the motor 231 and causes the palette 127 to move forward and backward, thereby the rod 82 is moved forward and backward by the palette 127 and causes the cutter B 68 to rotate as described above so as to perform the cutting operation.

After the cutting operation of the upper and lower threads near the cloth as such, when the color of the single thread is required to be changed, the control unit 28 transmits an operation command to the linear motor 98 and causes the rod 92 to move forward or backward so as to push the head 12 away.

At this time, the range of the movement in which the operating linear motor 98 moves the rod forward or backward corresponds to the position of the needle into which an upper thread of the color corresponding to the one selected in the operating panel 30 is fed, and the linear motor 98 is operated so as to move the rod forward and backward within the range.

Accordingly, the head 12 is moved slidingly along the rail 86 installed the upper part of the arm 88 by the rod 92 moving forward or backward as such, at the same time a part of the power provided from the main-shaft driver unit 16 is transmitted to the shaft C 90 and causes the needle which feeds a single thread of corresponding color to move up and down so as to embroider on the cloth installed to the embroidery frame 4.

Alternatively, the operation procedure of the mono-axis table 131 coupled with the rod 92 is as follows.

First, when the motor 141 receives an operation command from the control unit 28, the screw 139 is rotated leftward and rightward by the motor 141 and causes the palette 137 to move forward and backward, thereby the rod 92 is moved forward and backward by the palette 137 and pushes or pulls the head 12 so as to change the color of the single thread.

The operation according to the embodiment of the invention for feeding a single thread to the cloth fixed to the embroidery frame 4 is as follows.

First, when the reversible motor 320 is operated by the command from the control unit 28, the driver lever 322 is rotated repeatedly and causes the driver gear 324 engaged with the sector gear to rotate in positive or reverse direction. Accordingly, the thread-snatch unit 326 coupled with the driver gear 324 is moved up and down repeatedly and pulls the single thread located above the embroidery frame downward.

In the step of feeding the single thread as such, when the linear motor 308 is operated up and down by the command from the control unit 28, the needle holder control block 314 coupled with the slider 310 slides along the needle holder shaft 312 and operates up and down repeatedly.

As a result of this, the fixed bracket 316 inserted into the central portion of the needle holder control block 314 is moved up and down together with the needle holder 318, and feeds the single thread from the thread-snatch unit 326 to the cloth fixed to the embroidery frame 4.

In the meanwhile, the operation according to another embodiment of the invention is as follows.

First, when the controller 337 transmits an operation command to a head group comprising a plurality of head 334, or several head groups, the operation of the head group(s) is as follows.

When one pattern is required to embroider on the cloth in the embroidery frame 336 in order to produce the embroideries in small quantities according to the product characteristics, the controller 337 transmits operation commands to respective heads 334 constituting each head group located on the working plate 332.

In addition, when the controller 337 transmits operation commands to the linear motors 342, 344 respectively installed at one side and the rear part of the embroidery frame 336 in order to form the embroidery patterns, the embroidery frame 336 moves in X or Y direction on the working platen 332.

Alternatively, when two kinds of embroidery patterns or a medium-amount of production is required, the controller 337 transmits respective commands to two head groups so as to operate the linear motor 342, 344, so as to cause the embroidery frame 336 to move in X or Y direction. At this time, the controller 337 can be set so that one pattern or two patterns can be embroidered on the cloth of the embroidery frame 336.

In another way, when a mass production is required, the controller 337 transmits respective commands to the linear motor 342 constituting the three head groups so as to move the embroidery frame 336 in X or Y direction. At this time, the controller 337 can be set so that one pattern to three patterns can be embroidered on the cloth of the embroidery frame 336. Accordingly, various patterns are embroidered on the cloth at the same time, and mass production of the embroidery product is possible when the three head groups are operated simultaneously.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. An embroidery machine comprising:

a plurality of heads installed above a working table and spaced apart from each other;

a needle holder installed inside each head and slidingly movable up and down;

a plurality of hooks installed at a lower part of each needle holder and vertically opposite to the needle holder;

a plurality of embroidery frames installed between the needle holder and the hook, and movable in an X or Y direction;

a guide rail disposed in the X direction with respect to each embroidery frame;

an X-axis driver linear motor for moving the embroidery frame in the X direction while moving along the guide rail;

a guide rail disposed in the Y direction with respect to each embroidery frame;

a Y-axis driver linear motor for moving the embroidery frame in the Y direction while moving along the guide rail; and a controller for controlling a plurality of X-axis and Y-axis driver linear motors, wherein the controller actuates or stops only one of the plurality of embroidery frames.

2. The embroidery machine of claim 1, wherein a fixed bracket is installed at one side of the X-axis driver linear motor, a side frame in the Y direction of the embroidery frame is slidingly movably coupled to the fixed bracket.

3. The embroidery machine of claim 1, wherein a fixed bracket is installed at one side of the Y-axis driver linear motor, a side frame in the X direction of the embroidery frame is slidingly movably coupled to the fixed bracket.

4. The embroidery machine of claim 1, wherein the controller causes the plurality of embroidery frames to embroider one pattern or to embroider selectively different patterns with respect to one another.

5. An embroidery machine comprising:

a plurality of heads installed in groups above a working table and spaced apart from each other;

a needle holder installed inside each head and slidingly movable up and down;

a vertical driver means mounted on one side of each head and causing the needle holder to move up and down;

a plurality of hooks installed at a lower part of each needle holder and vertically opposite to the needle holder;

a small-sized motor mounted on a rotary shaft of each hook;

a plurality of embroidery frames installed on an upper surface of the working table according to each head group, and movable in an X or Y direction;

a guide rail disposed in the X direction with respect to each embroidery frame;

an X-axis driver linear motor for moving the embroidery frame in the X direction while moving along the guide rail;

a guide rail disposed in the Y direction with respect to each embroidery frame;

a Y-axis driver linear motor for moving the embroidery frame in the Y direction while moving along the guide rail; and a controller for controlling the plurality of vertical driver means, the plurality of small-sized motors, and the plurality of X-axis and Y-axis driver linear motors, wherein a reversible motor controlled by the controller is installed inside each head, a thread-snatch unit driver lever is mounted on the rotary shaft of the reversible motor, and a thread-snatch unit making vertical rocking motion is coupled to one end portion of the thread-snatch unit driver lever.

6. The embroidery machine of claim 5, wherein the vertical driver unit comprises a guide rail disposed vertically inside the head, and a vertical-driving linear motor that moves along the guide rail and causes the needle holder to move up and down.

7. The embroidery machine of claim 6, wherein a needle holder control block which moves slidingly along a needle holder shaft is coupled to one side of the vertical-driving linear motor, and one side of the needle holder of the head is fixed to an end portion of the needle holder control block.

8. The embroidery machine of claim 5, wherein a fixed bracket is installed at one side of the X-axis driver linear motor, a side frame in the Y direction of the embroidery frame is slidingly movably coupled to the fixed bracket.

9. The embroidery machine of claim 5, wherein a fixed bracket is installed at one side of the Y-axis driver linear motor, a side frame in the X direction of the embroidery frame is slidingly movably coupled to the fixed bracket.

10. The embroidery machine of claim 5, wherein the controller actuates or stops only one of the plurality of embroidery frames.

11. The embroidery machine of claim 5, wherein the controller causes the plurality of embroidery frames to embroider one pattern or to embroider selectively different patterns with respect to one another.

12. An embroidery machine comprising:

a plurality of heads installed above a working table and spaced apart from each other;

a needle holder installed inside each head and slidingly movable up and down;

a plurality of hooks installed at a lower part of each needle holder and vertically opposite to the needle holder;

a plurality of embroidery frames installed between the needle holder and the hook, and movable in an X or Y direction;

a guide rail disposed in the X direction with respect to each embroidery frame;

an X-axis driver linear motor for moving the embroidery frame in the X direction while moving along the guide rail;

a guide rail disposed in the Y direction with respect to each embroidery frame;

a Y-axis driver linear motor for moving the embroidery frame in the Y direction while moving along the guide rail; and a controller for controlling a plurality of X-axis and Y-axis driver linear motors, wherein the controller causes the plurality of embroidery frames to embroider one pattern or to embroider selectively different patterns with respect to one another.

13. The embroidery machine of claim 12, wherein a fixed bracket is installed at one side of the X-axis driver linear motor, a side frame in Y direction of the embroidery frame is slidingly movably coupled to the fixed bracket.

14. The embroidery machine of claim 12, wherein a fixed bracket is installed at one side of the Y-axis driver linear motor, a side frame in the X direction of the embroidery frame is slidingly movably coupled to the fixed bracket.

15. The embroidery machine of claim 12, wherein the controller actuates or stops only one of the plurality of embroidery frames.

16. An embroidery machine comprising:

a plurality of heads installed in groups above a working table and spaced apart from each other;

a needle holder installed inside each head and slidingly movable up and down;

a vertical driver means mounted on one side of each head and causing the needle holder to move up and down;

a plurality of hooks installed at a lower part of each needle holder and vertically opposite to the needle holder;

a small-sized motor mounted on a rotary shaft of each hook;

a plurality of embroidery frames installed on an upper surface of the working table according to each head group, and movable in an X or Y direction;

a guide rail disposed in the X direction with respect to each embroidery frame;

an X-axis driver linear motor for moving the embroidery frame in the X direction while moving along the guide rail;

a guide rail disposed in the Y direction with respect to each embroidery frame;

a Y-axis driver linear motor for moving the embroidery frame in the Y direction while moving along the guide rail; and a controller for controlling the plurality of vertical driver means, the plurality of small-sized motors, and the plurality of X-axis and Y-axis driver linear motors, wherein the controller actuates or stops only one of the plurality of embroidery frames.

17. The embroidery machine of claim 16, wherein the vertical driver unit comprises a guide rail disposed vertically inside the head, and a vertical-driving linear motor that moves along the guide rail and causes the needle holder to move up and down.

18. The embroidery machine of claim 17, wherein a needle holder control block which moves slidingly along a needle holder shaft is coupled to one side of the vertical-driving linear motor, and one side of the needle holder of the head is fixed to an end portion of the needle holder control block.

19. The embroidery machine of claim 16, wherein a reversible motor controlled by the controller is installed inside each head, a thread-snatch unit driver lever is mounted on the rotary shaft of the reversible motor, a thread-snatch unit making vertical rocking motion is coupled to one end portion of the thread-snatch unit driver lever.

20. The embroidery machine of claim 16, wherein a fixed bracket is installed at one side of the X-axis driver linear motor, a side frame in the Y direction of the embroidery frame is slidingly movably coupled to the fixed bracket.

21. The embroidery machine of claim 16, wherein a fixed bracket is installed at one side of the Y-axis driver linear motor, a side frame in the X direction of the embroidery frame is slidingly movably coupled to the fixed bracket.

22. The embroidery machine of claim 16, wherein the controller causes the plurality of embroidery frames to embroider one pattern or to embroider selectively different patterns with respect to one another.

23. An embroidery machine comprising:

a plurality of heads installed in groups above a working table and spaced apart from each other;

a needle holder installed inside each head and slidingly movable up and down;

a vertical driver means mounted on one side of each head and causing the needle holder to move up and down;

a plurality of hooks installed at a lower part of each needle holder and vertically opposite to the needle holder;

a small-sized motor mounted on a rotary shaft of each hook;

a plurality of embroidery frames installed on an upper surface of the working table according to each head group, and movable in an X or Y direction;

a guide rail disposed in the X direction with respect to each embroidery frame;

an X-axis driver linear motor for moving the embroidery frame in the X direction while moving along the guide rail;

a guide rail disposed in the Y direction with respect to each embroidery frame;

a Y-axis driver linear motor for moving the embroidery frame in the Y direction while moving along the guide rail; and a controller for controlling the plurality of vertical driver means, the plurality of small-sized motors, and the plurality of X-axis and Y-axis driver linear motors, wherein the controller causes the plurality of embroidery frames to embroider one pattern or to embroider selectively different patterns with respect to one another.

24. The embroidery machine of claim 23, wherein the vertical driver unit comprises a guide rail disposed vertically inside the head, and a vertical-driving linear motor that moves along the guide rail and causes the needle holder to move up and down.

25. The embroidery machine of claim 24, wherein a needle holder control block which moves slidingly along a needle holder shaft is coupled to one side of the vertical-driving linear motor, and one side of the needle holder of the head is fixed to an end portion of the needle holder control block.

26. The embroidery machine of claim 24, wherein a reversible motor controlled by the controller is installed inside each head, a thread-snatch unit driver lever is mounted on the rotary shaft of the reversible motor, a thread-snatch unit making vertical rocking motion is coupled to one end portion of the thread-snatch unit driver lever.

27. The embroidery machine of claim 24, wherein a fixed bracket is installed at one side of the X-axis driver linear motor, a side frame in the Y direction of the embroidery frame is slidingly movably coupled to the fixed bracket.

28. The embroidery machine of claim 24, wherein a fixed bracket is installed at one side of the Y-axis driver linear motor, a side frame in the X direction of the embroidery frame is slidingly movably coupled to the fixed bracket.

29. The embroidery machine of claim 24, wherein the controller actuates or stops only one of the plurality of embroidery frames.

* * * * *